US006500102B1

(12) United States Patent
Domenge

(10) Patent No.: US 6,500,102 B1
(45) Date of Patent: Dec. 31, 2002

(54) INERTIAL EXERCISER DEVICE AND METHOD

(76) Inventor: Alberto G. Domenge, Fuente de las Aguilas #194, Tecamachalco (MX)

( * ) Notice: Subject to any disclaimer, the term of this patent is extended or adjusted under 35 U.S.C. 154(b) by 0 days.

(21) Appl. No.: 09/510,147

(22) Filed: Feb. 22, 2000

(51) Int. Cl.[7] ..... A63B 21/22

(52) U.S. Cl. ..... 482/110; 482/148; 472/135; 446/236

(58) Field of Search ..... 482/68, 77, 78, 482/136, 148, 110; 446/409, 431, 236, 490, 168–171, 450–453, 266, 26–28; 472/135; 473/52, 130, 125; 272/128; 273/109, 322; D21/92

(56) References Cited

U.S. PATENT DOCUMENTS 983,372 A 2/1911 Johnson
1,676,015 A * 7/1928 Feick
2,821,394 A 1/1958 Barbeau
2,948,531 A * 8/1960 Johnson
2,999,333 A * 9/1961 Clark ..... 46/47
3,013,806 A * 12/1961 Boyd
3,083,037 A * 3/1963 Gorden et al.
3,083,979 A * 4/1963 Boyd
3,157,961 A * 11/1964 Payne ..... 46/51
3,334,915 A * 8/1967 Sulyma et al.
3,403,906 A 10/1968 Burzenski
3,464,718 A * 9/1969 Fisher
3,482,835 A 12/1969 Dean
3,708,164 A 1/1973 Griffin
3,796,431 A 3/1974 Sinyard
3,809,393 A 5/1974 Jones
3,867,787 A * 2/1975 Weinger ..... 46/100
3,901,505 A * 8/1975 Gerechter ..... 273/1 M
4,043,553 A 8/1977 Suarez
4,049,264 A * 9/1977 Holcombe, Jr. ..... 272/74
4,150,580 A 4/1979 Silkebakken et al.
4,171,805 A 10/1979 Abbott
4,278,248 A 7/1981 Kifferstein
4,429,487 A * 2/1984 Taylor et al. ..... 46/43
4,458,895 A * 7/1984 Turcotte ..... 272/115

(List continued on next page.)

FOREIGN PATENT DOCUMENTS

DE 2043395 3/1972
GB 2244009 A * 11/1991

*Primary Examiner*—Jerome W. Donnelly
*Assistant Examiner*—Lori Baker Amerson
(74) *Attorney, Agent, or Firm*—Greenblum & Bernstein, P.L.C.

(57) ABSTRACT

A method of exercising and various exercise devices. The exercise device includes a substantially circular hoop, the hoop comprising a hollow chamber for allowing a member to move within the chamber. One of at least one handle or at least one mechanism is attached to the hoop for supporting the hoop at a location on a user's body. At least one member is disposed in the hollow chamber, wherein the hoop is postionable around a portion of the user's body. The exercise device can also include at least one substantially circular casing comprising a hollow chamber for allowing a member to move within the chamber and a centrally disposed through opening. A handle rod at least partially disposed within the opening, and at least one member is moveably disposed in the hollow chamber. The casing is removably fixed to the handle rod so that movement of the handle rod causes movement of the at least one member within the casing. The exercising method includes positioning a hoop device about a portion of a user's body, securing the hoop device on the user using at least one securing mechanism which fixes the hoop device with respect to the portion of the user's body, moving the hoop device with corresponding movement of the user's body so as to cause a weight disposed in a hollow chamber of the hoop device to move about.

50 Claims, 18 Drawing Sheets

U.S. PATENT DOCUMENTS 4,501,434 A * 2/1985 Dupuis ..... 280/206
4,513,963 A 4/1985 Nelson et al.
4,579,336 A * 4/1986 Morin ..... 272/115
4,632,391 A 12/1986 Orak
4,703,928 A 11/1987 Escher
4,714,246 A 12/1987 Parisien
4,775,147 A 10/1988 Bold, Jr.
4,900,017 A 2/1990 Bold, Jr.
5,046,727 A 9/1991 Wilkinson et al.
5,163,888 A 11/1992 Stearns
5,244,445 A 9/1993 Amesquita
5,304,108 A 4/1994 Denega et al.
5,643,162 A 7/1997 Landers et al.
5,707,325 A 1/1998 Chiou
5,792,031 A * 8/1998 Alton ..... 482/78
6,099,444 A * 8/2000 Domenge ..... 482/110
6,179,758 B1 * 1/2001 Domenge ..... 482/110

* cited by examiner

INERTIAL EXERCISER DEVICE AND METHOD

BACKGROUND OF THE INVENTION

1. Field of the Invention

The present invention relates to exercise devices and, more particularly, to exercise devices which use the principle of inertia in order to enhance and intensify an exercise performed with such inertial exercise devices. The invention also relates to methods of exercising using the devices.

2. Discussion of Background Information

In recent years people have become more and more conscious of the need to exercise in order to maintain a healthy life-style. Many different types of exercise have become popular and some exercises are directed or devoted to improving various aspects of the body's fitness and performance. A comprehensive list of such types of exercises and exercise devices is, in today's society, overwhelming. Many people have become confused as to what exercise and what type of exercise device is suitable for their purposes. Thus, many types of exercise devices are of common knowledge to an informed consumer or physical fitness devotee. There are many examples of such exercise devices, including inertial-type exercise devices.

U.S. Pat. No. 3,796,431 discloses an exercising device in the form of a dumbbell. The device is provided with rotatable spherical weights, which allow the device to be rolled along a flat surface such as a floor or wall, in addition to lifting the device in the conventional manner.

U.S. Pat. No. 4,900,017 is a device similar to that described above, in which an inertial force exercise device includes a wheel member operable to engage and roll on a surface during an exercise routine. An axle member is required to extend in a predetermined manner so as to be controlled by an operator of the device. An inertial mass structure is connected to the axle for translation with the axle, without rotation with respect to the axle, for providing an inertial resistance through non-rotational translation so as to exercise a user's body. Due to the mass of the device a substantial linear inertia is produced.

U.S. Pat. No. 4,714,246 discloses an exercise device in the form of a disk provided with handles, and a resilient ball tethered to the center of the disk. By imparting a predetermined motion to the tethered ball, it can move in predetermined directions while bouncing periodically inside the disk. Various weights can be attached individually or a plurality of weights can be attached simultaneously.

U.S. Pat. No. 4,513,963 is directed to a body exercise device having a tubular member provided inside thereto with an axially disposed rotatable bar member, the external ends of which are provided with radial pieces or connectors parallel to each other. A weight is provided adjacent to the end of the connector not attached to the rod. The connector that rotates the weights is limited in radius and can possibly harm the user as the weights are free in the sense that they are not protected from causing injury to the user.

U.S. Pat. No. 4,043,553 discloses an exercising device with eccentric weights. Hand grips are provided to be rotatably secured to an eccentric weighted cross shaft. The device includes two spaced ends and at least one generally cylindrical griping portion between the ends. The frame may be rotated within the hand grip and an eccentric weighted means for the frame is located adjacent each spaced end. The weighted means comprises an intermediate coupling element having a first coupling means for fixedly and non-rotatably coupling the element to the frame at one of the spaced ends.

U.S. Pat. No. 4,140,580 discloses a hand-held ball shaped case having a shaft mounted inertial wheel or rotor provided with fins. The casing leaves exposed part of the rotor, so that an initial spin can be imparted to it and afterwards, the rotor spins so that it is maintained by imparting a periodic motion thereto. The device is basically a gyroscope with a race designed for providing smooth rotor movement.

U.S. Pat. No. 3,809,393 discloses an exercise device having a handle supported by at least three swivel casters. The device can be moved about a floor. However, the device does not appear to truly be an inertial exercise device as it does not produce inertial resistance to movement imparted to the device by a user.

U.S. Pat. No. 4,775,147 is an inertial exercise device having three independent rotational inertial systems. A plurality of wheel and axle elements are required to cooperate with weight elements so that rolling of the devices produces an inertial force. The device appears to be for floor-type exercise and is directed to an open-type, non-protected weight element for providing the inertial force when receiving initial movement by a user.

U.S. Pat. No. 4,171,805 is directed to a rollable hand held exercise device that requires an additional, stationary element for providing a rolling surface. The device is not a true inertial-type exercise device as it requires a special surface to provided rolling contact surfaces which the user must use in conjunction with the weights so as to guide the weights in a manner designed to force certain muscle groups to work.

U.S. Patent No. 5,046,727 is a wrist exercise device having a hollow shaft which houses a spring element. Tension disks are connected to the springs so that the disks can be moved toward and away from each other by turning a tension adjusting knob at ends of the device.

U.S. Pat. No. 5,643,162 discloses an exercise apparatus which is used in a forward and/or lateral movement in an extension type of exercise. While rolling and/or sliding of the device is considered, inertial exercise is not truly disclosed. This is an example of a low-friction type exercise device that, on its surface, may appear to be an inertial exercise device. However, It is apparent that low-friction type exercise does not imply an inertial exercise element.

U.S. Pat. No. 5,707,325 discloses an exercise device relating to a roller type device. The exerciser includes a roller for rolling along a first direction from a first position. Intermediate positions are defined as the device proceeds from the first position to the final position. The route of the device is then repeated back to the start position. Energy storing means are provided to effect movement from one position to another. The storing devices are springs which are contracted and released as the device moves from one position to another.

U.S. Pat. No. 5,163,888 discloses a exercising apparatus in which different linkages are moved in response to movement of a user. The movements of the various links function to provide a resistance against which the user must work.

U.S. Pat. No. 5,304,108 discloses a resist and assist exercising device. The device allows the user to impart movement to the exercise device along a particular direction and the user may continue the application of force in that direction. Alternatively, the user may resist the force imparted to the first direction by trying to impart force in another direction. However, while the exerciser is of the assist/resist type, the device operates by use of an essentially weightless mass. Thus, it is not a true inertial type exercise device.

U.S. Pat. No. 3,403,906 discloses an exerciser with grippers mounted on a shaft. This exerciser is again a roller type exercise device which does not require the user to work against an inertia imparted to the device by the user.

U.S. Pat. No. 3,708,164 discloses a manual torsion exerciser in which a torsional member is positioned within a tubular member and extends from the outer end part of one tubular member to the outer end part of another tubular member. A retainer member is releasible engaged with one end of the torsional member so that the torsional member will be placed under torsional stress upon rotation of one tubular member relative to the other tubular member.

U.S. Pat. No. 2,821,394 discloses a spring-roller type exercise device in which the device is designed to be rolled on a floor so as to cause the user to impart force to a coil-type spring. Movement back and forth of the exerciser along the floor coils and uncoils the spring, forcing the user to work against the spring force in a coiling and uncoiling mode.

U.S. Pat. No. 4,703,928 discloses a precessional exercise device designed only for foot exercises. A spinning mass forms the rotor of a motor for spinning the mass. Rotational movement of the foot is opposed by a gyroscopic effect produced by the spinning mass. This produces an isometric exercise effect when the foot is rotated while the torque of the spinning mass is opposed by other muscles of the foot.

U.S. Pat. No. 5,244,445 discloses an exercise wand. The wand has a hollow rigid tube having a length sufficient to extend a substantial distance to either side of the body median plane. A plurality of spheres are enclosed in the hollow wand. Movement in one direction causes the spheres to roll in the wand from end to end and add momentum to the movement so as to provide an extra push to the movement of the body.

U.S. Pat. No. 3,482,835 discloses a barbell with an eccentric weight. Movement of the barbell causes a force to be imparted to the weight so that it rotates eccentrically about the shaft of the barbell. The device uses the effects of centrifugal force to require the user to coordinate his/her movement of the barbell with the movement of the eccentric weight.

The foregoing devices are of different types and are designed to produce different results. Each type of exercise device has its own advantages and disadvantages. However, all of the known exercising devices have at least one common disadvantage. That is, they do not utilize the effects of inertia to permit a user to first impart movement to an exercise device and then work against the movement in a variety of ways so as to provide a complete workout for a user or team of users. The foregoing devices require the use of, among others, tension springs, compression springs, eccentrically mounted weights, offset shafts, etc. All of which unnecessarily complicate such exercising devices and necessarily lead to an increased cost of manufacture and a consequent increased cost to the consumer.

SUMMARY OF THE INVENTION

The invention of the present application was developed to overcome the problems of the known exercising devices. More particularly, the invention was developed to provide an inertial exercise device that is effective in promoting healthy exercise with a minimum of stress to the muscle groups so a to thereby avoid injuries often associated with exercise. In addition, the inertial exercise device of the present invention relies on a simple, though ingenious, design for coaxing a maximum workout from a user while at the same time permitting the user to enjoy the workout.

To this end, the invention of the present application was developed to provide an inertial exercise device having a first housing member, a second housing member connected to the first housing member so as to define a recess between the first housing member and the second housing member. At least one substantially spherically weight member is located in the recess in a manner so as to be movable therein. A holding element is connected to at least on of the first housing member and the second housing member so that a user of the exercise device can impart and control movement of the exercise device. Movement of the exercise device imparts a moment of inertia to the weight member so as to require increased resistance by the user as the inertia of the weight member is increased.

Another aspect of the present invention is to provide a first arcuate inner member section connected to an exterior wall of the first housing member. A second arcuate inner section is connected to an exterior wall of the second housing member. A first flat ring is secured to the first arcuate inner section and a second flat ring is secured to the second arcuate inner section. A securing element connects the first flat ring and the second flat ring so that the first housing member and the second housing member, the first arcuate inner section, the second arcuate inner section, the first flat ring and the second flat ring are maintained in a fixed positional relationship.

Another object of the present invention is to provide an inertial exercise device having a connecting part extending from the first flat ring and the second flat ring so that the holding element is connected to the first flat ring and the second flat ring. An adjusting member is connected to the holding element to permit adjustment of the holding element in accordance with a size of the user of the exercise device.

A further object of the invention is to provide an inertial exercise device wherein the holding element is a handle member fixedly secured to one of the first housing member and the second housing member.

Another object of the invention is an inertial exercise device having a third housing member, a fourth housing member connected to the third housing member so as to define a recess between the third housing member and the fourth housing member. At least one substantially spherical weight is located in the recess in a manner so as to be movable therein and a bar element is fixedly secured to one of the first housing member and the second housing member and also one of the third housing member and the fourth housing member.

Still another object of the invention is to provide an inertial exercise device having a third housing member and in which the first housing member is substantially a right circular cylinder. The second housing member encloses a first end of the first housing member and the third housing member encloses an opposite end of the first housing member.

A further object of the invention is an inertial exercise device having a spring member positioned in the first end and the opposite end of the first housing member, the weight member being positioned in the recess defined by the right circular cylinder and the spring member so as to be movable therein.

Another object of the invention is to provide an inertial exercise device which includes two such devices connected together with the second exercising device having housing members like the first exercise device and having a connecting member connecting the two exercise devices.

Another object of the invention is an inertial exercise device having spring members positioned in ends of the housing member with the weight member positioned in the recess defined by the right circular cylinder and the spring members so as to be movable therein a fastening member is connected to the connecting member so as to fasten a first end and a second end of the connecting member in an adjustable manner. The connecting member is attached to a body part of the user to impart one of a linear and a circular motion to the inertial exercise devices when the user imparts a force to the devices.

Another object of the invention is to provide the inertial exercise device with semi-spherical shaped housing members.

Another object of the invention resides in the housing members being connected to the bar element so that the housing members are substantially flat on a side which connects to the bar element. The flat housing sides being substantially perpendicular.

A further object of the invention is to provide a plurality of weights in each of the recesses of the exercise device.

Still another object of the invention is to provide an inertial exercise device having a ring-shaped housing member and a substantially circular housing member with an open portion concentric with the ring housing member. A pair of circular side walls extend from a base portion of the circular housing member so as to define a recess therebetween.

Another object of the invention is to provide the inertial exercise device with securing elements fixedly connecting the ring-shaped member to the circular member so as to enclose the recess and to have at least one substantially spherical weight member located in the recess so as to be movable therein.

Another object of the invention is to provide a pair of handles extending from one of the ring members and the circular housing so as to allow a user to grasp and control movement of the device.

Another object of the invention is the provision of upper and lower surfaces of the ring member which are substantially flat and parallel. The circular housing member has a bottom wall surface and an open portion wall surface each of which is substantially flat and parallel with each other and the ring shaped member.

Another object is to provide a pair or circular side walls substantially parallel and spaced from each other by a distance that is approximately equal to a width of the ring member.

Another object is the provision of a pair of circular side walls that are substantially parallel and spaced from each other by a distance that is approximately equal to a width of the ring member.

Another object of the invention is to provide an inertial exercise device having a plurality of substantially spherical weights located in the recesses.

Still a further object of the invention is the inclusion of swivel casters fixedly secured to the base portion of the circular housing member.

Another object of the invention is to provide the swivel caster in an eccentric mounting position with respect to a location of being fixedly secured to the base portion.

Another object of the invention is to provide an inertial exercise device having a control panel extending from an exterior side wall of the circular housing member and receptacles provided on the control panel for receiving both feet of a user of the device. The user imparting movement to the device through use of leg muscles of the user.

Another object of the invention is to provide an inertial exercise device with a substantially arcuate member having substantially flat, parallel top and bottom sidewalls and a substantially straight segment integrally connected to the first and the second arcuate members and having a base portion and vertically extending side walls. A second substantially straight segment is integrally connected to the first and second arcuate members and has a substantially flat parallel top and bottom wall element. A recess is formed by the bottom wall and the vertically extending sidewall portions. The second arcuate member and the interconnecting segment being fixedly secured to the vertically extending sidewall so as to enclose the recess. A substantially spherical weight member is located in the recess.

Still another object of the invention is to provide an inertial exercise device with a set of handles connected to an arcuate member and another set of handles connected to another arcuate member. At least one user of the device can grasp one of the first and second set of handles while the exercise device is adjacent the abdomen or other body part of the user so as to impart motion to the weight so as to move the weight along a predetermined pathway.

According to one aspect of the invention, there is provided an inertial exerciser, comprising: a substantially circular hoop, the hoop comprising a hollow chamber for allowing a member to move within the chamber. At least one handle is disposed on the hoop and at least one mechanism attached to the hoop for supporting the hoop at a location on a user's body. At least one member is disposed in the hollow chamber, so that the hoop is postionable around a portion of the user's body. The member may comprise a substantially spherical weight. The weight may have a diameter which substantially corresponds to the cross-sectional size of the hollow chamber. The at least one mechanism may comprise a shoulder strap for supporting the hoop on the user. The at least one mechanism may comprise at least two adjustable shoulder straps for supporting the hoop on the user.

The exerciser may further comprise at least one handle disposed on the hoop for gripping by the user and at least one mechanism for securing the exerciser to the user. The exerciser may further comprise at least two handles disposed on the hoop for gripping by the user. The hoop may further comprise a substantially square cross-sectional hollow chamber. The hoop may further comprise a substantially square cross-sectional casing. The hoop may further comprise at least two semi-circular segments. That one of the semi-circular segments may comprise at least one tooth on one of its ends for allowing the weight to move within the hollow chamber in an uninterrupted manner. Each semi-circular segment may comprise at least one tooth and wherein one tooth from one segment engages another tooth from another segment. The exerciser may further comprise a plurality of teeth disposed on each segment. The hoop may further comprise a connecting device for connecting the at least two semi-circular segments. The connecting device may also include a hinge device.

The hoop may further comprise a securing device for connecting the at least two semi-circular segments and a securing device may comprises clasp device. The hoop may comprise at least two hollow chambers. Each chamber may include at least one member, the at least one member further comprising a weight. The exerciser may further comprise a separating wall disposed between the at least two chambers. The at least two chambers can be arranged one above the other in a parallel relationship.

According to another aspect of the invention, there is provided a method of exercising, comprising: positioning a hoop device about a portion of a user's body; securing the hoop device on the user using at least one securing mechanism which fixes the hoop device with respect to the portion of the user's body; moving the hoop device with corresponding movement of the user's body so as to cause a weight disposed in a hollow chamber of the hoop device to move about. The hoop device may comprise a substantially circular hoop having a substantially circular hollow chamber. The positioning may further comprise opening the hoop device, the hoop device being split into at least two semi-circular segments, closing the hoop device about the user's body and securing the ends of the semi-circular segments together using a securing device. The securing may further comprise disposing at least one strap which attached to the hoop on a user's shoulder. The securing may further comprise disposing at least two straps which are attached to the hoop on each of the user's shoulders. The positioning may comprise positioning the hoop device in the area of the user's waist. The moving may comprise grasping at least one handle disposed on the hoop.

The invention also provides for an inertial exerciser, comprising at least one substantially circular casing, the casing comprising a hollow chamber for allowing a member to move within the chamber and a centrally disposed through opening, a handle rod at least partially disposed within the opening; and at least one member moveably disposed in the hollow chamber, wherein the casing is removably fixed to the handle rod so that movement of the handle rod causes movement of the at least one member within the casing. The at least one member comprises a substantially spherical weight. The weight may have a diameter which substantially corresponds to a cross-sectional size of the hollow chamber. The handle rod may comprise a frictional gripping surface. The gripping surface may comprise one of a raised surface, a knurled surface, and a textured surface.

The exerciser may further comprise at least one retention device mounted to the handle rod for preventing axial movement of the at least one casing. The exerciser may also further comprise at least two retention devices disposed on opposite sides of the at least one casing. The hollow chamber may comprises a substantially square cross-section. The at least one casing may comprise a substantially circular first portion having a member engaging inner inside diameter, a member engaging outer inside diameter, and a member engaging connecting wall. The at least one casing may comprise a second portion comprising a member engaging wall. The second portion may comprise an inside diameter portion which at least partially covers an outer diameter portion of the first portion of the casing. The at least one casing may be centrally disposed on the handle rod and axially retained by two retaining devices, each retaining device being disposed on opposite sides of the casing. The at least one casing may be disposed on one end of the handle rod and axially retained by two retaining devices, each retaining device being disposed on opposite sides of the casing. The at least one casing may be disposed on one end of the handle rod and be axially retained by two retaining devices, each retaining device being disposed on an opposite side of the casing and wherein at least one other casing is disposed on the other end of the handle rod and is axially retained by two retaining devices, each retaining device being disposed on an opposite side of the casing. The at least two casings may be axially retained on each end of the handle rod. The at least one member may comprises a plurality of substantially spherical weights.

The casing may further comprise a removable substantially circular wheel portion having a through opening for allowing the handle rod to extend therethrough. The circular wheel portion may comprise an outside diameter which engages the at least one member.

BRIEF DESCRIPTION OF THE DRAWINGS

The present invention is further described in the detailed description which follows, with reference to the plurality of drawings by way of non-limiting examples of preferred embodiments of the present invention. In the drawings, like reference numerals represent similar parts throughout the several views of the drawings, and wherein.

DETAILED DESCRIPTION OF THE INVENTION

The particulars show herein are by way of example and for purposes of illustrative discussion of the embodiments of the present invention only and are presented in the cause of providing what is believed to be the most useful and readily understood description of the principles and conceptual aspects of the present invention in more detail than is necessary for the fundamental understanding of the present invention, the description taken with the drawings making apparent to those skilled in the art how the several forms of the present invention may be embodied in practice.

The inertial exercise device of the present invention is useable in many different ways, such as hand-held in any position as in the palm of a user's hand in order to develop hand, wrist and arm muscles. The device can be held in front of the body, over the head, in the region of the hips and/or abdomen so as to effect the various muscle groups of the body. The inertial exercise device may be used alone or by pairs or groups of users. The inertial exercise device provides for continual change of direction of a spherical weight so as to increase the mass momentum and the resistance that must be overcome to control the device. In this respect, the inertial exercise device provides a resistance that a user of the device must overcome and control during the exercise. This movement is not unidirectional as is the case with gravity and spring-based exercise devices.

In an inertial exercise device, as the speed of the exercise is increased, the moment of inertia of the weights is increased and so is the resistance that the gymnast or user must overcome. Using an inertial exercise device can prolong the time of the exercise since the weights, once set in motion, require relatively little energy to keep them moving. The inertial principles on which the exerciser is based makes it ideal for aerobic exercises that tend to promote general fitness and to improve cardiovascular conditioning.

Figure 1:
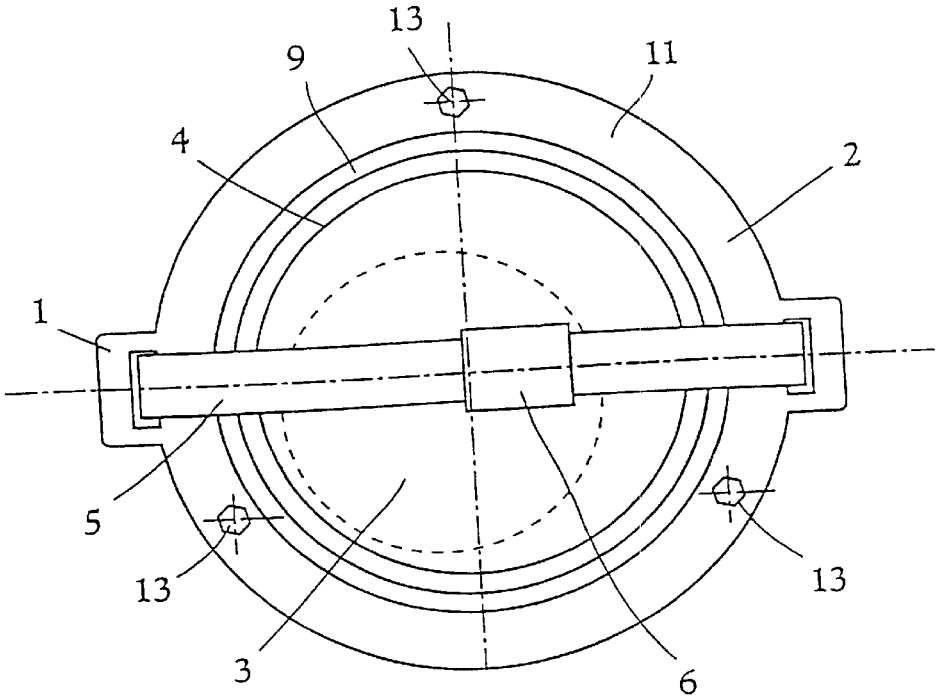
FIG. 1. represents a top cross-sectional view of a spherical hand-held exerciser, provided with an external spherical hollow casing and a smaller internal spherical shaped weight, capable of rotating within the walls of the spherical casing, and provided with a hand strap.

FIG. 1 is a side cross-sectional view of the inertial exercise device. Therein, a hand-held device 1 is shown in which an external hollow substantially spherical casing 2 contains a smaller diameter solid spherical shaped weight 3 which can roll or slide by inertia on the inner surface 4 of the hollow spherical casing 2. The casing 2 is provided with an external strap 5 that permits attachment of the exercise device to a hand of the user. The strap 5 is provided with a buckle 6 so as to permit adjustment of the strap 5 and permit comfort and adjustment of the exerciser to the hand of the user. Two semi-spherical elements 7 and 8 form the external casing 2. The semi-spheres 7 and 8 are provided with securing elements that secure the two semi-spheres 7 and 8, one to the other. The securing elements are in the form of external rings having arcuate inner sections 9 and 10. The arcuate inner sections are of a size corresponding to fit the outer surfaces of the semi-spheres 7 and 8. Flat rings 11 and 12 are rigidly secured to the rings 8 and 9 and tightly secured to each other by screws or and other suitable securing element 13.

When a substantially elliptical movement is imparted to the exerciser 1, by movement of the hand of the user, the spherical shaped weight or weights 3 roll or slide on the inner surface 4 of the casing 3. Movement of the spherical shaped weight or weights 3 causes the weight to be displaced in a circular movement in a given plane of rotation. The plane of rotation being determined by the position of the device and its orientation by the user of the device.

Figure 2:
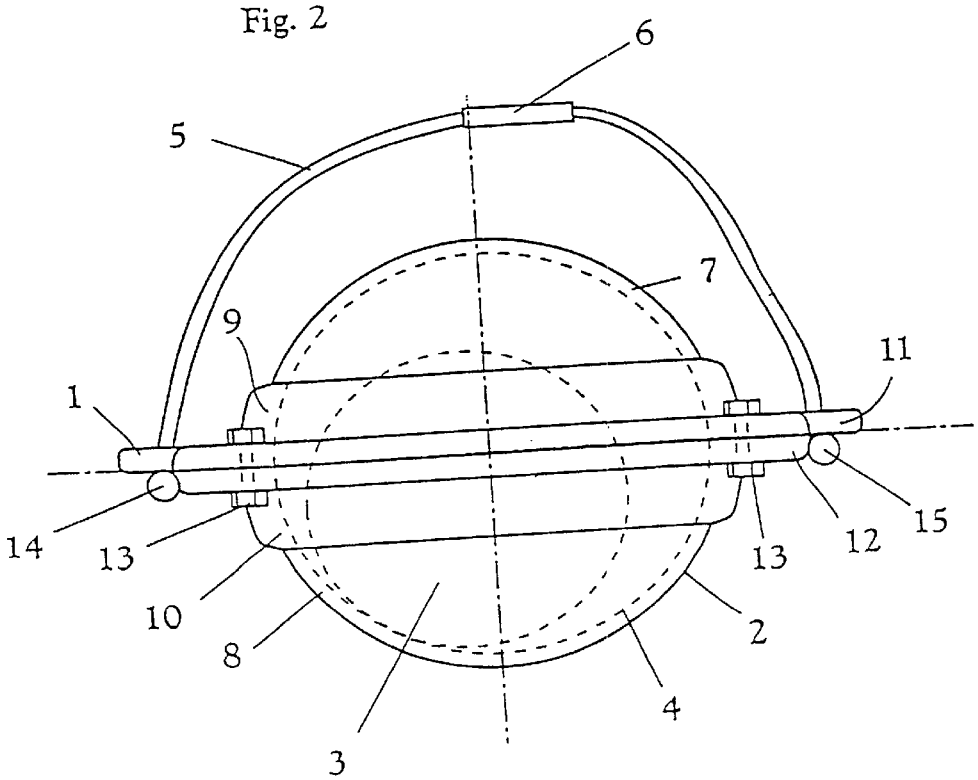
FIG. 2 is a lateral cross-sectional view of the hand-held exerciser of FIG. 1.

FIG. 2 of the exerciser 1 shows that the hollow spherical casing is formed by a top hollow semi-sphere 7 and a bottom hollow semi-sphere 8. The rings 9 and 10 are rigidly attached to the flat rings 11 and 12 which, in turn, are tightly secured to each other by screws or appropriate securing elements 13. The strap 5 and adjustment buckle 6 is attached to the top flat ring 11 at an outermost diametrical position of the ring 11. The points of attachment are shown at 14 and 15.

Figure 3:
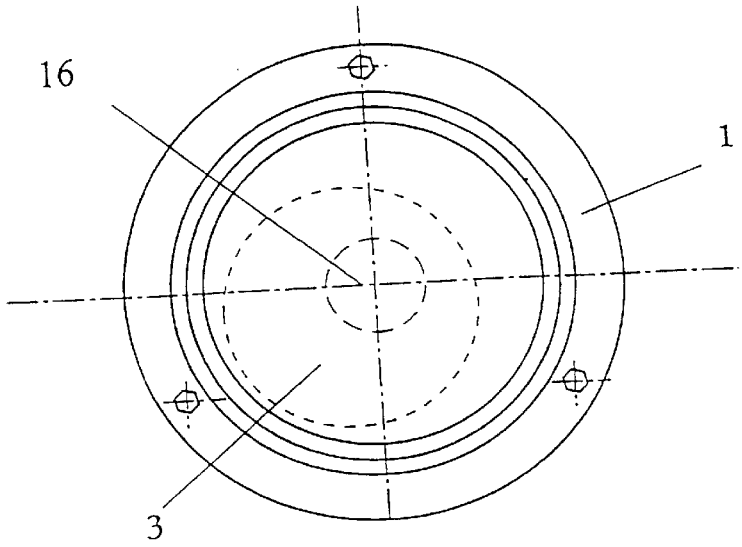
FIG. 3 is a top cross-sectional view of a spherical hand-held exerciser provided with a handle.
Figure 4:
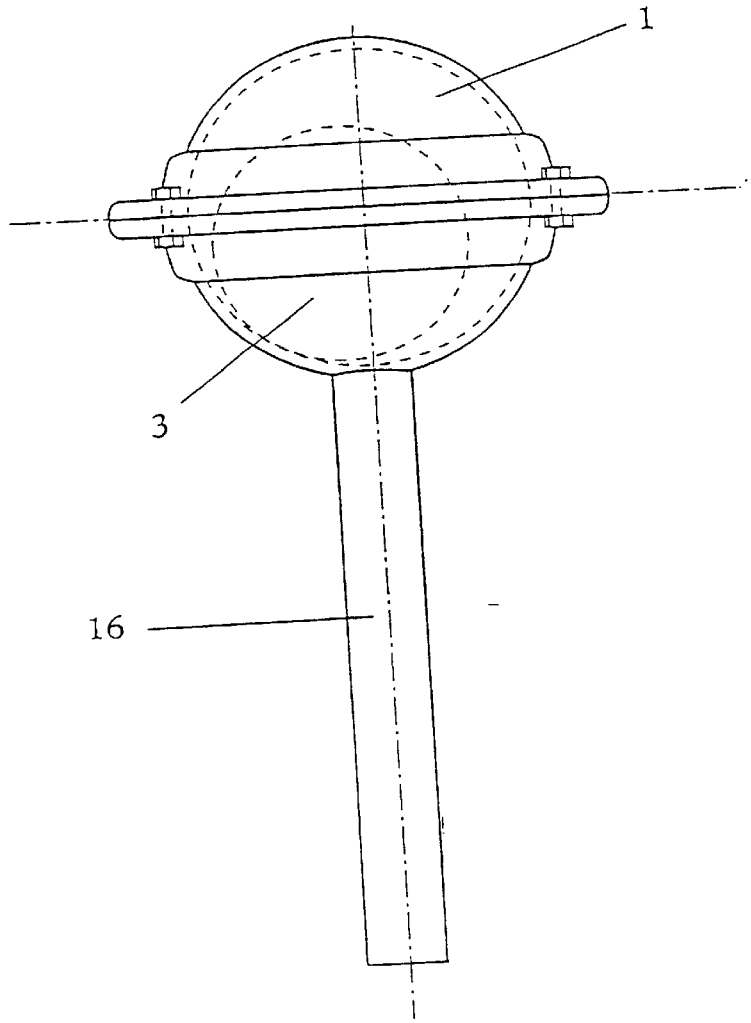
FIG. 4 is a longitudinal side view of the exerciser of FIG. 3.

FIGS. 3 and 4 show the exerciser device 1 provided with a handle member 16. The handle is attached to the spherical casing 2 at a bottom center area of the semi-sphere 8. In the alternative, the handle 16 can be attached to the semi-sphere 7. By providing a handle member instead of the strap 5, different types of movement, and consequent different types of exercise can be performed. It is apparent that grasping the handle 16, at different lengths along the handle would provide different types of exercise as the fulcrum point would shift, with respect to the hand of the user, so as to require more or less effort in holding and/or imparting movement to the exerciser 1. While the handle 16 is shown as being attached to the semi-sphere 8 at a bottom central region thereof, it is apparent that other regions of attachment to the semi-spheres 7 and 8 could also be provided.

Figure 6:
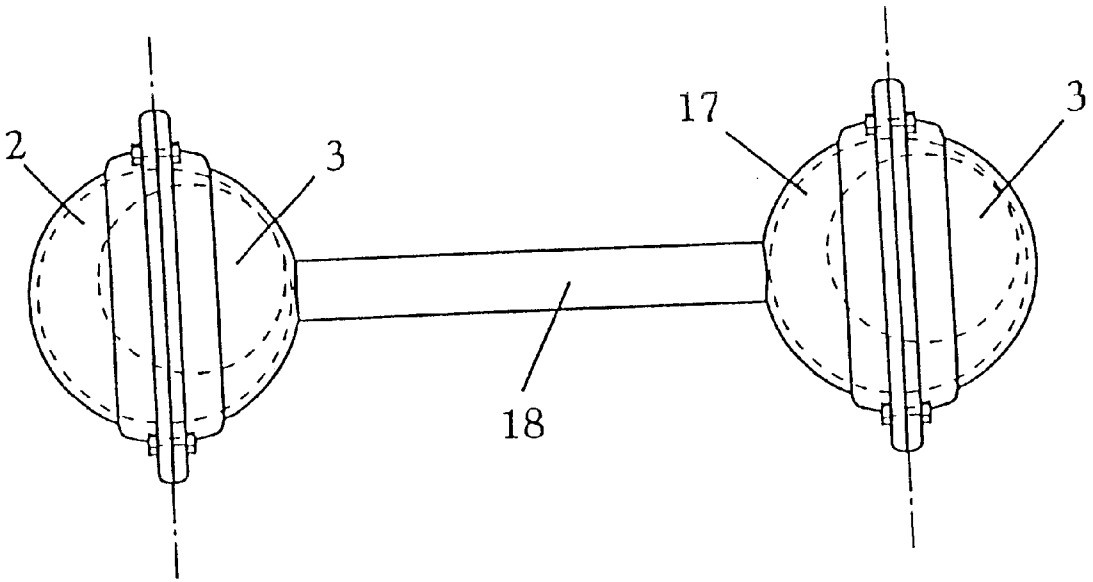
FIG. 6 is a front cross-sectional view of the exerciser of FIG. 5.
Figure 5:
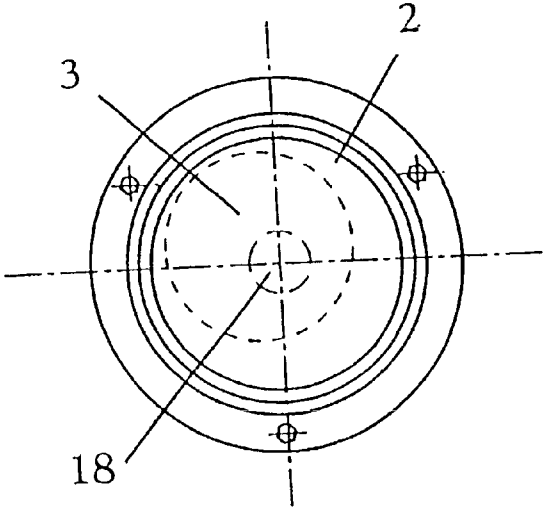
FIG. 5 is a side cross-sectional view of an exerciser provided with a central gripping bar and two lateral spherical casings connected thereto.

FIGS. 5 and 6 are show a variation of the device shown in FIGS. 1–4 and is an example of the inertial exercise device of the invention used as a barbell or dumbbell type exerciser. Therein, two of the spherical type inertial devices 1 are attached at either end of a bar or handle 18. The bar or handle 18 is attached to the casing 2 in a manner substantially similar to the attachment of the handle 16 as shown in FIGS. 3 and 4. The opposite end of the handle or bar 18 is attached to the other inertial exercise device 17 in a substantially similar manner as that of the attachment to casing 2 of the first exercise device. The external casings 2 and 17 of the exerciser devices are connected by a central bar or handle 18. Depending on the length of the central bar or handle 18, a user of the device may use two of the devices shown in FIGS. 5 and 6 by using one in each hand, or, in the alternative, a single device may be grasped with both hands of the user grasping the bar or handle 18. As in the first variant of the invention, motion is imparted to the spherical weights contained in the hollow spherical casings by the user. The user exercises by setting the spherical weights in motion and then works against the inertial of the moving weights so as to control movements of the weights and thereby exercise muscle groups during a workout.

Figure 7:
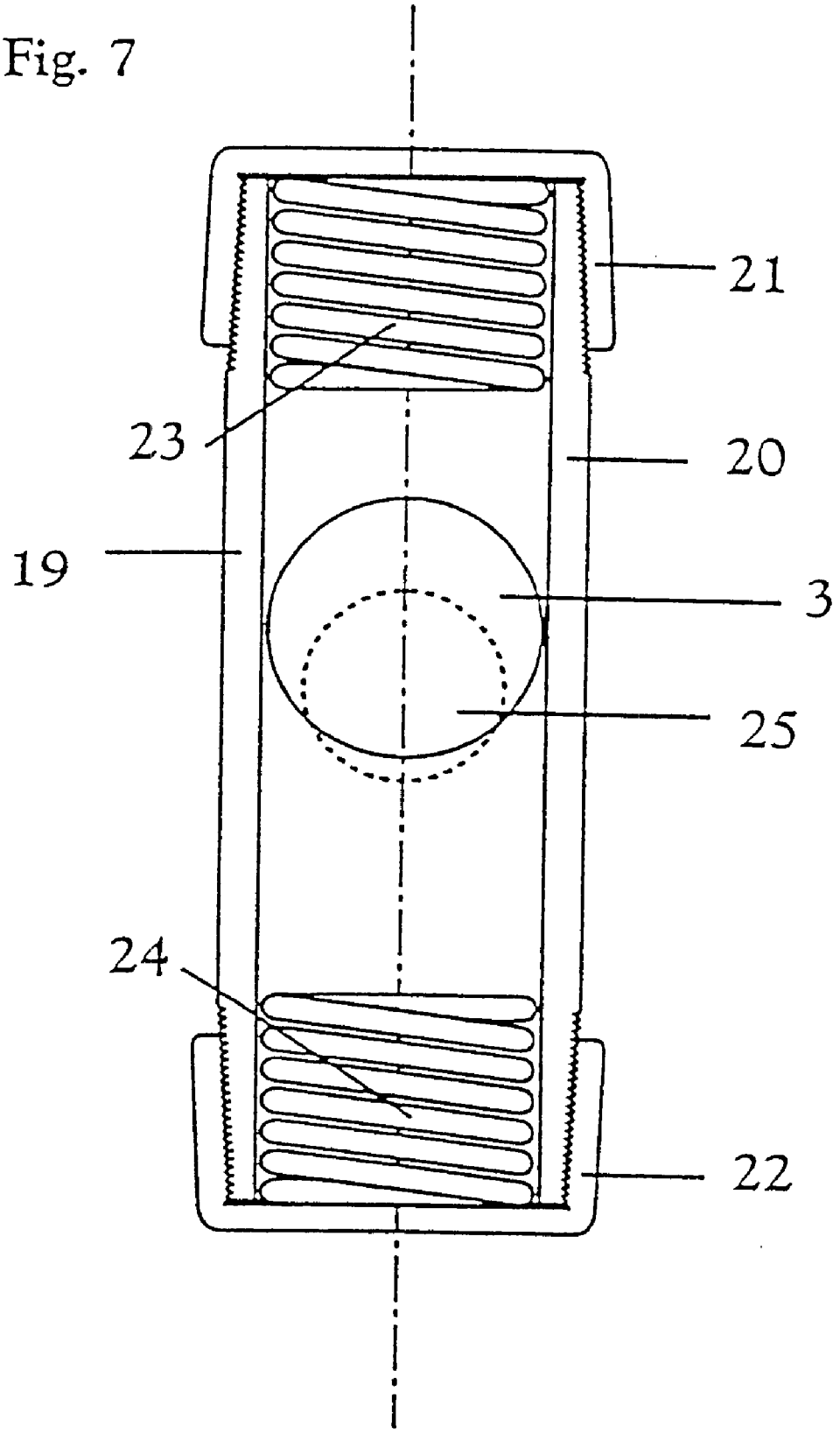
FIG. 7 is a top cross-sectional view of a hand-held exerciser having a tubular casing, a movable spherical shaped weight and lateral coil springs.
Figure 8:
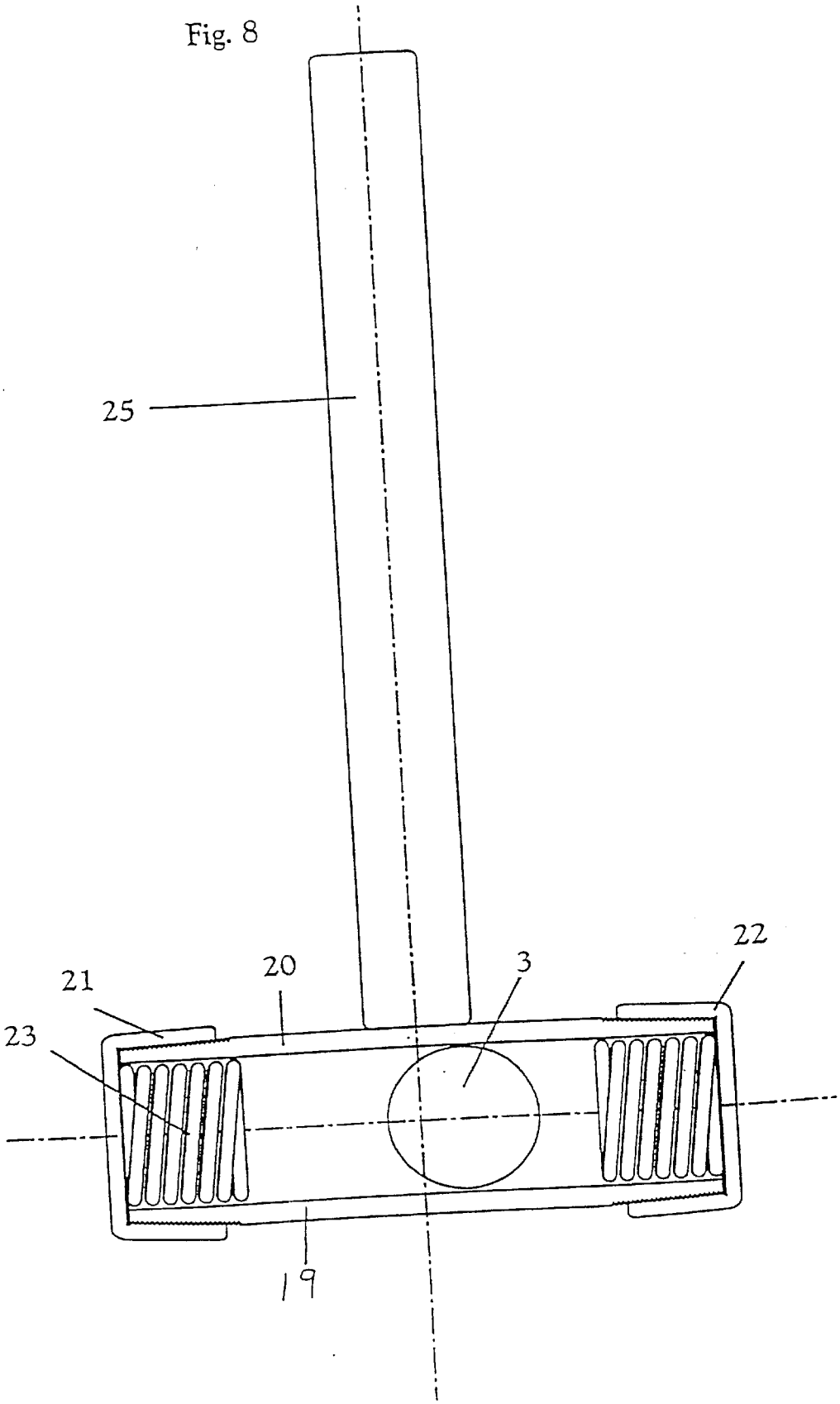
FIG. 8 is a front cross-sectional view of the exerciser described in FIG. 7.

FIGS. 7 and 8 are related views of another variant of the inertial exerciser of the present invention. In this variation, an exerciser 19 is provided with a cylindrical external casing 20. The casing 20 has end blockers or caps 21 and 22 located at opposite ends of the casing 20. The end blockers or caps 21 and 22 enclose the cylindrical external casing 20 so as to provide an enclosed chamber for the inertial exerciser. Coil springs 23 and 24 are located at opposite ends of the chamber as defined by the casing 20 and end blockers 21, 22. A spherical shaped weight 3 is positioned within the casing and located between the coil springs 23, 24. The casing 20 is provided with a handle 25. As in the foregoing variations. A user of the device grasps the handle 25 so as to impart motion to the exerciser 19. The motion thus imparted causes the spherical weight to roll or slide within the casing 20. The weight contacts the end springs which cushion the motion of the weight and also impart a force to the weight by release of spring energy stored by the compression of the springs. Of course, the springs 23 and 24 are compressed by the contact and compressive effects caused by the spherical weight 3. Due to the compression of the springs 23 and 24, the potential energy caused by the compression is released and the kinetic energy of the expansion of the springs 23,24 also imparts a force to the weight 3 to urge the weight in the opposite direction of movement within the casing 20. The handle 25 is shown as attached to the casing 20 at approximately a central region of the casing 20. Other regions of attachment are also possible with the handle 25 being offset from a central region of the casing 20 and includes the possibility of the handle being attached to the caps 21 or 22. The handle 25 could be replaced by the strap and buckle arrangement 5, 6 shown in FIG. 1.

Figure 9:
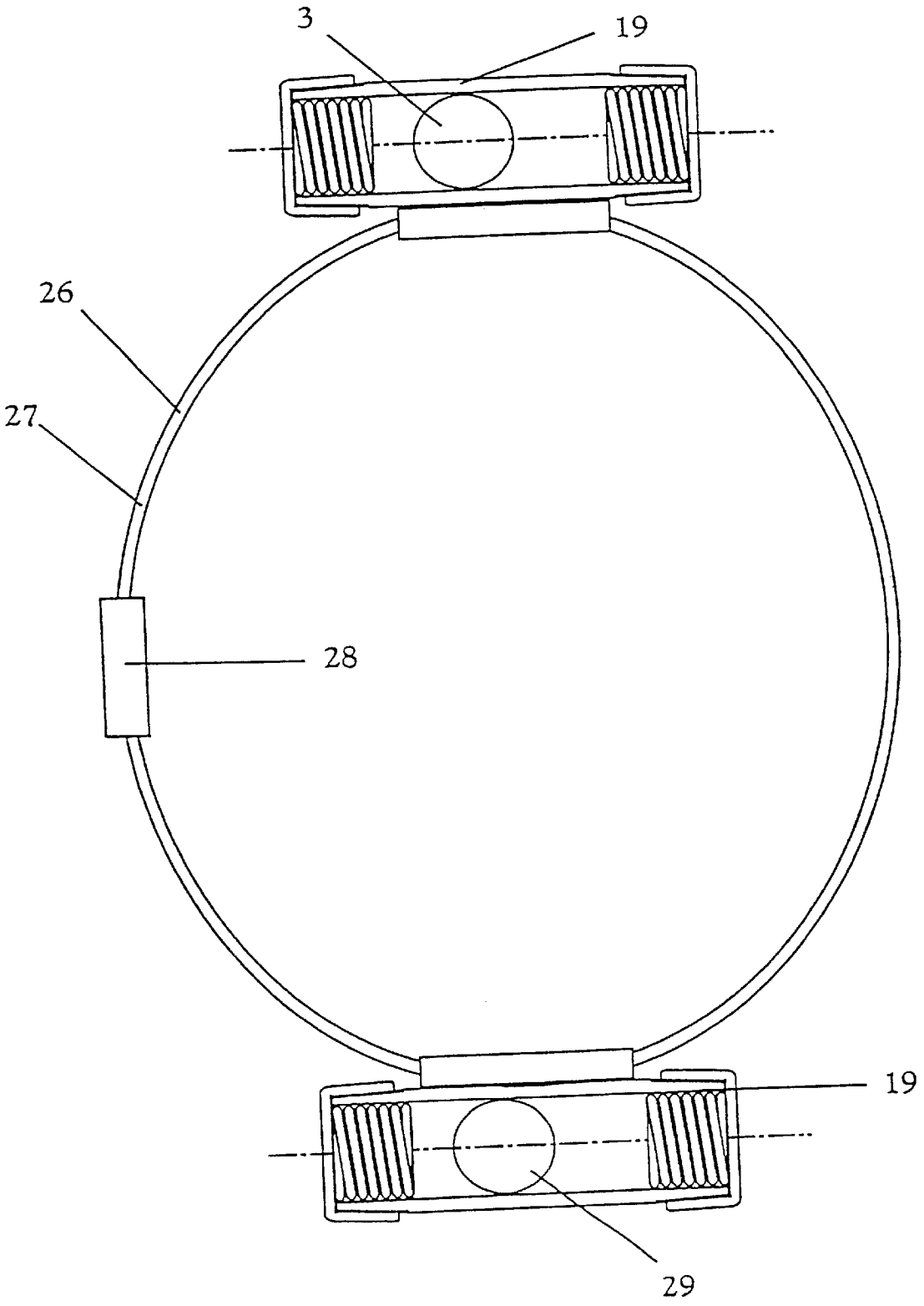
FIG. 9 is a top cross-sectional view of an exerciser having a belt positioned preferably by the hips of the user, and provided with two lateral, substantially tubular casings having two coil springs positioned by internal ends, and a spherical shaped weight, capable of reciprocating therewith.

FIG. 9 is a top cross-sectional view of an exerciser 26 which incorporates some of the features of the exerciser shown in FIGS. 7 and 8. Therein, two inertial exercise devices 19, as shown in FIGS. 7 and 8 are provided without the handle 25. Specifically, each exercise device 19 has a cylindrical external casing 20 with end blockers or caps 21, 22. A pair of coil springs 23, 24 are positioned at internal end regions of the device 19. A substantially spherical shaped weight 3, 29 is located in each of the exercise devices 19. In operation, the weights and springs function in substantially the same manner as the variation of FIGS. 7 and 8. However, in FIG. 9 two exercise devices 19 are provided and each has an attachment portion on a side of the spherical external casing 20 so as to provide an exerciser 26. The exerciser 26 includes a belt 27 and a buckle 28. The belt 27 is attached to the inertial exercisers 19 at the attachment portion provided on the side of the casing 20. In this variation, the belt and attached exercisers are strapped to the body of a user, preferably in the hip or abdomen region of the user's. Worn in this manner, the exerciser 26 has motion imparted thereto by movement of the users body so as to reciprocate the weights 3 and 29 in the same or opposite directions. For example, when a user attaches the exerciser 26 to his/her abdomen, a swivel movement of the user will result in the weights 3 and 29 reciprocating within the casing 20 in opposite directions of movement. A rocking or back-and-forth movement of the user would result in the weights 3 and 29 reciprocating in the same direction within the casings 20. The user exercises by imparting movement to the weights 3 and 29 in the same or opposite directions and then controlling movement of the weights by changing directions or movement of the weights 3 and 29 and/or controlling the speed of movement of the weights as they roll or slide within the casing 20.

Figure 11:
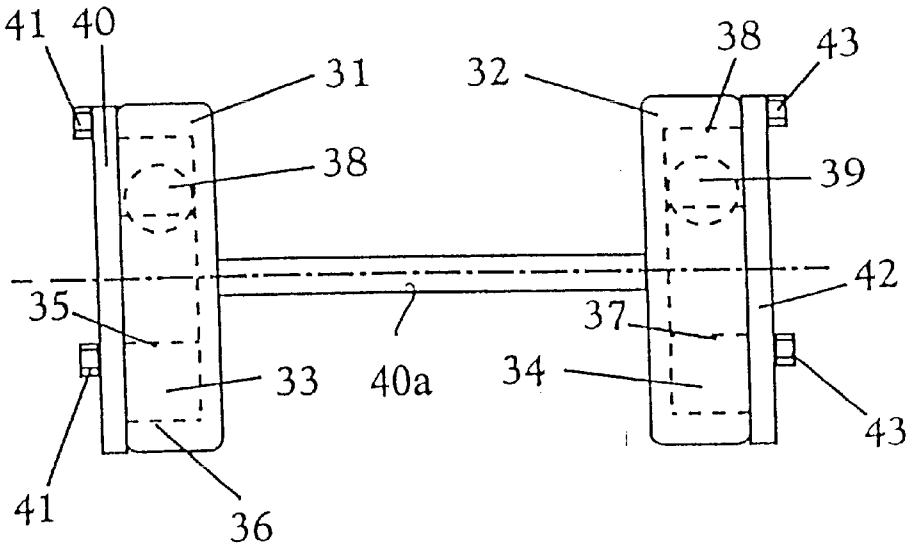
FIG. 11 is a front section of the hand-held exerciser of FIG. 10.
Figure 10:
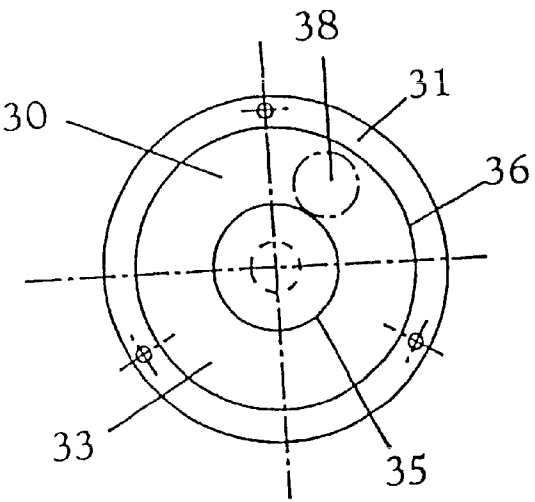
FIG. 10 is a lateral cross-sectional view of a hand-held exerciser, provided with a central rod with two lateral casings each having a substantial cylindrical recess for receiving a weight.

FIGS. 10 and 11 are side and front cross-sectional views of an exerciser 30, respectively. FIG. 11 shows an inertial exercise device 30 provided with lateral, spaced apart casing 31 and 32. Each of the casings 31 and 32 is provided with recesses 33 and 34. In the casing 31, first and second cylindrical walls 35 and 36 are provided, respectively. The casings 32 is provided with first and second cylindrical walls 37 and 38, respectively. A recess 33 is defined between the first and second cylindrical walls 35, 36 of the first casing 31. A recess 34 is defined between the first and second cylindrical wall 37, 38 of the casing 32. In each of the recesses 33 and 34, substantially spherical shaped weights 38 and 39 are provided so as to circulate within the recess by rolling and/or sliding. To contain the weights 38, 39 within the casings 31, 32, each casing is provided with a cover 40, 42. The covers are in the shape of a flat wall and are secured to the casings by securing elements 41 and 43. The securing elements 41, 43 may be in the form of screws, bolts or any other suitable securing element which can maintain the flat wall elements in a secured relationship to the casings 31, 32. The securing elements 41, 43 should permit removal of the flat wall elements 40 and 42 so as to provide a user with access to the interior of the casings. A bar or handle 40*a* connects the casings 31 and 32. As shown, the bar or handle 40*a* is located at a substantially central region of each of the casings 31, 32. Depending upon the length of the bar or handle 40*a*, the user of the exercise device 30 can grasp the device so as to use at a single device with both hands or use two such devices, one in each hand. By lifting and imparting at a motion to the exerciser 30, the weights 38, 39 are set in motion. By continuous movement in the same direction, the weights roll or slide within the recesses 33 and 34. In order to keep the weights moving, the user must continue applying movement to the exerciser 30. In order to control movement of the weights 38, 39, the user must exert force to stop the rolling/sliding motion of the weights This controlled movement may be in the form of stopping movement of the weights and/or reversing movement of the weights.

Figure 14:
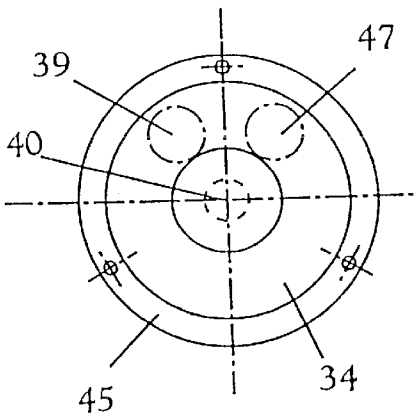
FIG. 14 is a right cross-sectional view of the exerciser provided with two spherical shaped weights as illustrated in FIGS. 12 and 13.
Figure 13:
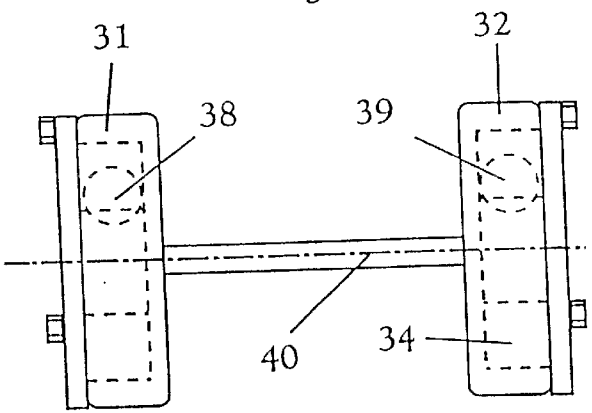
FIG. 13 is a front cross- sectional view of the exerciser of FIG. 12.
Figure 12:
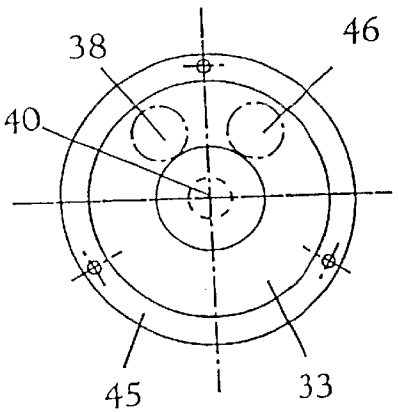
FIG. 12 is a left lateral cross-sectional view of an exerciser similar to that of FIGS. 10 and 11, provided with two equal spherical shaped weights.
Figure 16:
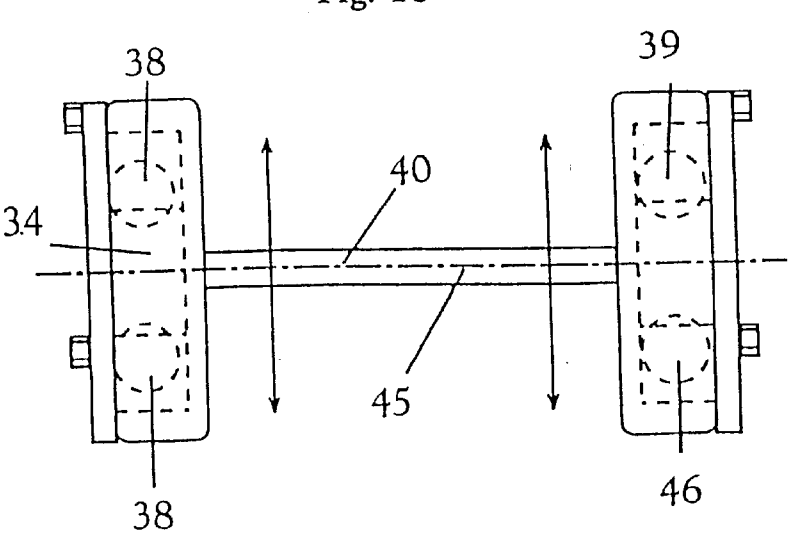
FIG. 16 is a front cross-sectional view of the exerciser of FIGS. 12–15 provided with arrows to indicate the linear reciprocating motion imparted to the exerciser in order to produce circular reciprocating motion of two equal, spherical weights.
Figure 15:
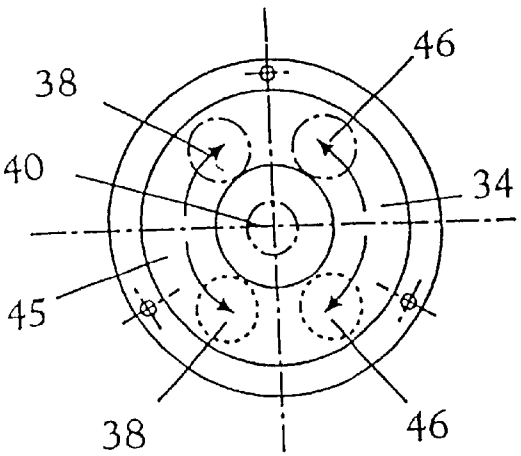
FIG. 15 is a lateral cross-sectional view of the exerciser of FIGS. 12–14 provided with arrows illustrating the circular reciprocating motion of the spherical weights.

FIGS. 12, 13 and 14 show an inertial exercise device 45 which is similar in structure to the exerciser 30. Accordingly, like parts will not be described in detail as reference may be made to the exerciser 30. In this variant, a plurality of weights are provided in each casing 31, 32. Thus, casing 31 is provided with substantially similar spherical weights 38 and 46. Casing 32 is provided with substantially similar spherical weights 39 and 47. The pairs of substantially similar spherical weights 39, 46 of the casing 31 and the pairs of substantially similar weights 39, 47 of casing 32 can roll and/or slide in their respective recesses 33 and 34. The user of the exerciser 45 can put the weights into at a circular motion by imparting an orbital, substantially elliptical motion to the exerciser 45. Alternatively, when the user imparts a substantially vertical, linear reciprocating motion to the exerciser 45, the two pairs of spherical weights 38, 46 and 39, 47, respectively, move in at a circular reciprocation motion in different directions. When the exerciser is moved downward, the weights 38, 46 move toward the top of the recess 33 and the weights 39, 47 move toward the top of recess 34. At this top part of the recesses 33, 34, the weights collide and change direction of their circular movement. When the exerciser 45 is pushed upwards, the spherical pairs of weights move toward a bottom region of the recesses 33, 34 and, in at a similar manner, collide with each other. This collision again changes direction of movement of the weights. This circular reciprocating motion of each pair of the weights can be maintained by continuously applying a substantially vertical, linear reciprocating motion. With reference to FIGS. 15 and 16, the movement of the weights is shown in more detail. Therein, the weights 38, 46 of casing 31 are shown, a similar showing of the weights 39, 47 is unnecessary as the same type of movement will be imparted thereto. In FIG. 15, two positions of the weights 38 and 46 are shown. FIG. 16 shows an arrow indicating a substantially vertical reciprocating direction of movement of the exerciser 45. Movement of the exerciser 45 in the manner shown in FIG. 16 imparts at a movement to the weights 38 and 46 as shown in FIG. 15. Due to gravitational force, when the exerciser is pushed or pulled in the upward vertical direction, the weights 38, 46 move toward the bottom of recess 33. Peripheral edges of the weights collide at approximately the bottom center of the casing 31. The collision of the weights cause the weights to change direction of movement within the recess 33. When the exerciser 45 is moved in at a downward vertical direction, the weights 38, 46 move toward the top of the recess 33. Here again, the weight collide and start to move in opposite directions along the recess 33. Thus, the user imparts a vertical motion to the exerciser 45 and then must continually work against the movement of the weights while continuing to impart the substantially vertical reciprocating motion.

Figure 17:
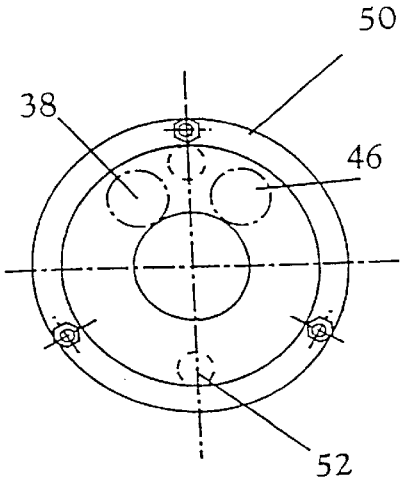
FIG. 17 is a lateral cross-sectional view in which lateral casings of the exerciser are connected by at least two holding handles.
Figure 18:
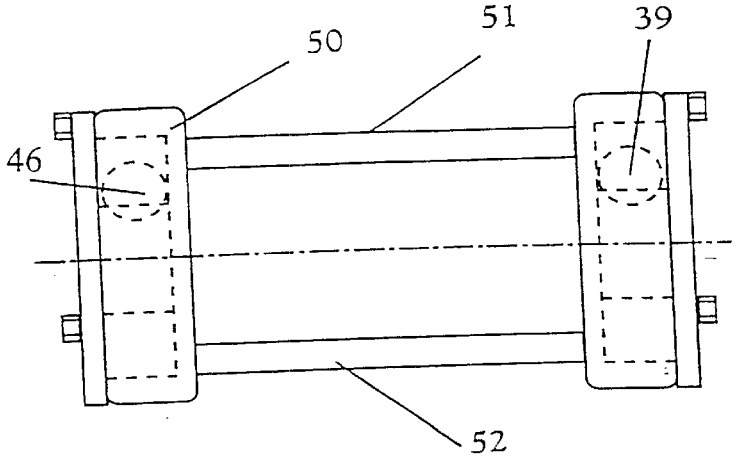
FIG. 18 is a side view of the device of FIG. 17.

FIGS. 17 and 18 show another form of the exerciser of FIGS. 12–14. The exerciser 50 shown in FIGS. 17 and 18 is similar to the exerciser 45. This variation uses two bars or handles 51 and 52 instead of the centrally positioned bar or handle 40*a*. This arrangement of the bars 51 and 52 permits a different exercise scenario. First, each of the bars 51 and 52 is offset from the center region of the casings containing the weights. As shown in FIG. 17 the bars 51, 52 are located on a central plane of the casing but displaced from the center region to adjacent at a peripheral edge portion of the casing. This structural arrangement permits two users to operate the exercise device 50 with each user gripping one of the bars 51, 52 with one or both hands. In this manner two or more users can impart an orbital substantially elliptical motion or a vertical linear reciprocating motion to the exerciser 50, so as to produce at a circular motion or a circular reciprocating motion, respectively, to the spherical shaped weights 38, 46 and 39, 47 shown in FIG. 15.

Figure 19:
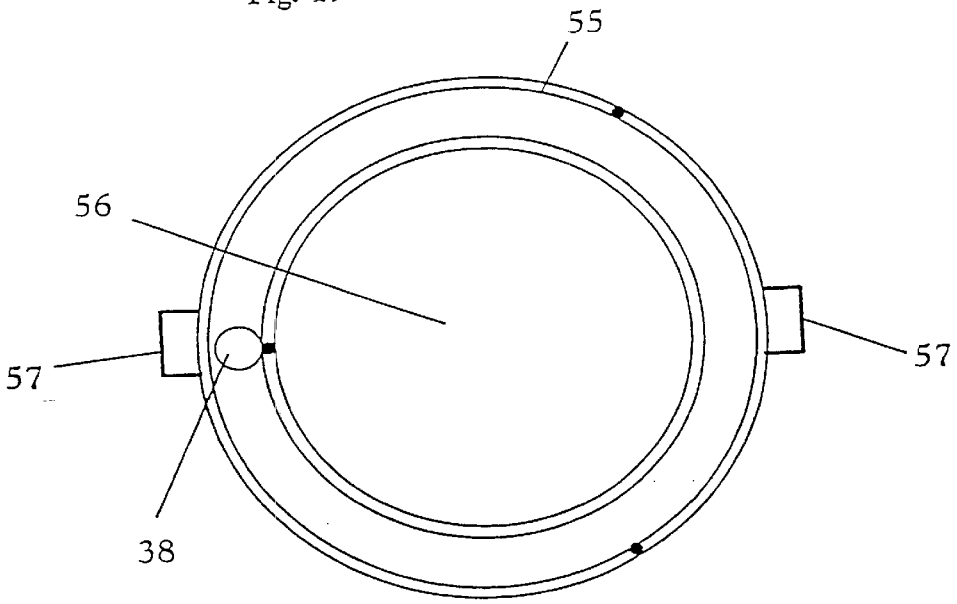
FIG. 19 is a top cross-sectional view of a hoop-like exerciser which is provided with a central cylindrical aperture and lateral, diametrically opposed handles.
Figure 20:
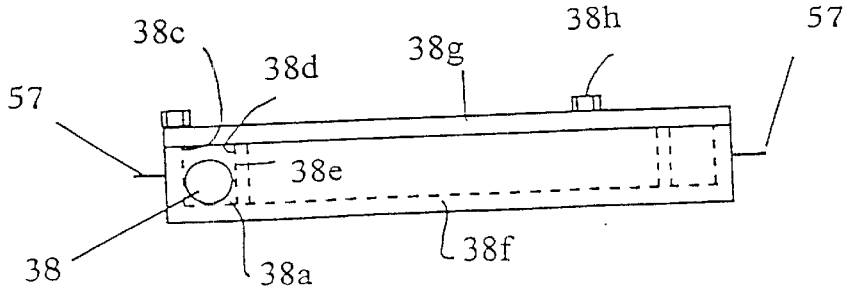
FIG. 20 is a frontal view of the hoop-like exerciser illustrated in FIG. 19.

FIG. 19 is at a top cross-sectional view of an exerciser 55 and FIG. 20 is at a side sectional view thereof. The exerciser 55 has at a circular concentric recessed section 56 and at a pair of external handles 57, shown on diametrically opposite sides of the exerciser. The exerciser 55 may be provided with a single spherical weight or a plurality of spherical weights, one of which is shown at 38. As shown, the exerciser 55 is somewhat similar to the exerciser 30, discussed above. A recess 38*a* is provided for the rolling/sliding movement of the spherical weight 38. The recess 38*a* is formed by an inner surface of an outer wall member 38*c* and an outer surface 38*d* of and inner wall member 38*e*. The wall members may be integral with at a bottom portion of casing 38*f*. The recess 38*a* is enclosed by at a top, substantially circular wall member 38*g* which may be secured to the bottom casing portion 38*f* by any appropriate securing element such as screws, bolts, etc., shown at 38*h*. In this variation, the exerciser may be held or positioned about the waist region of at a user. By grasping the handles to position the exerciser, the user can securely hold the exerciser in position while imparting motion to the weight and then controlling movement of the weights. Of course, many positions are available for using this exerciser. For example, the user may hold the exerciser above his/her head with both arms raised. In this position, the user can impart an orbital substantially elliptical motion or an approximately linear reciprocating motion in a substantially horizontal plane.

Figure 21:
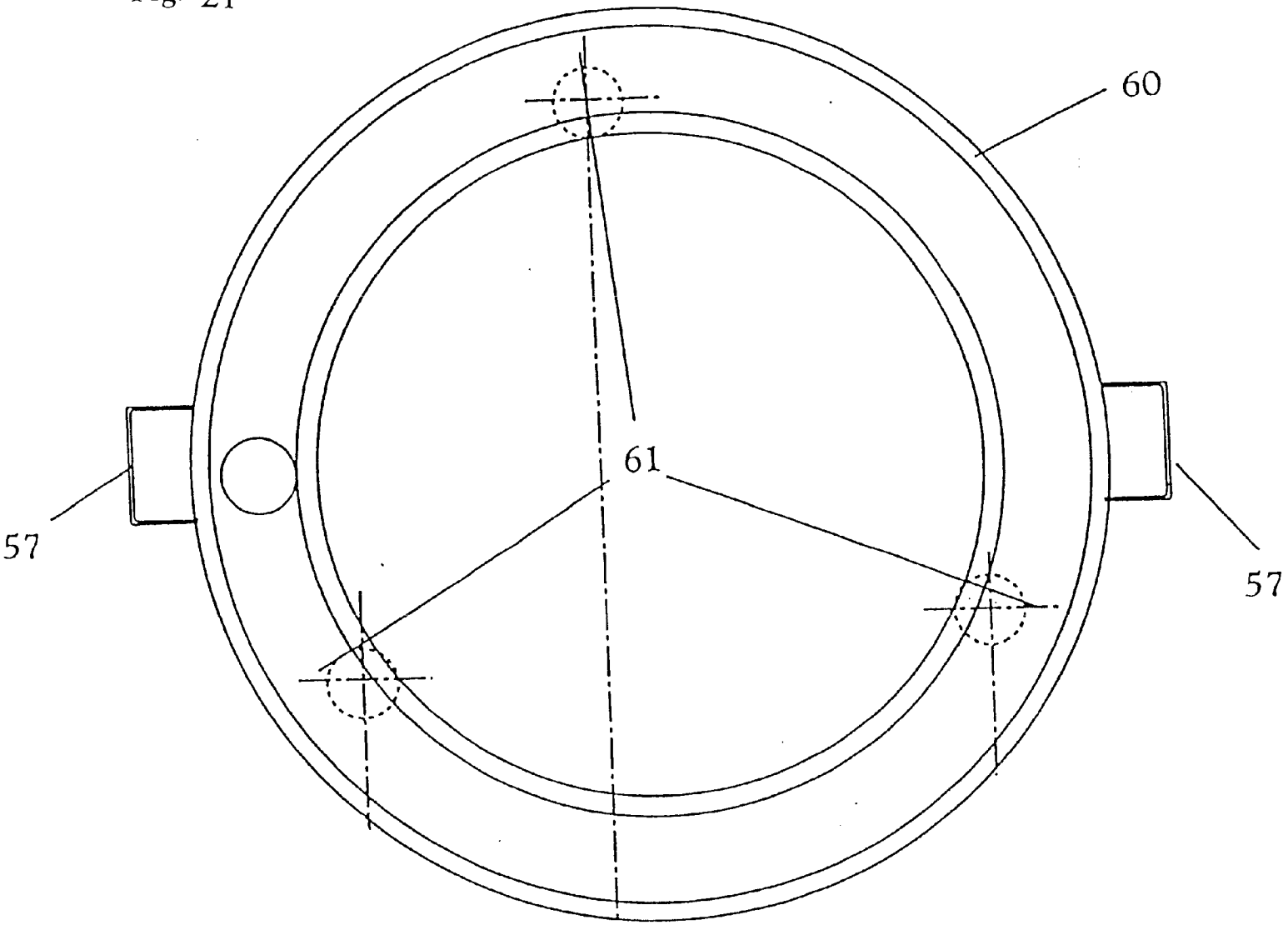
FIG. 21 is a top view of another variation of the inertia exerciser provided with a plurality of handles and eccentric wheels.
Figure 22:
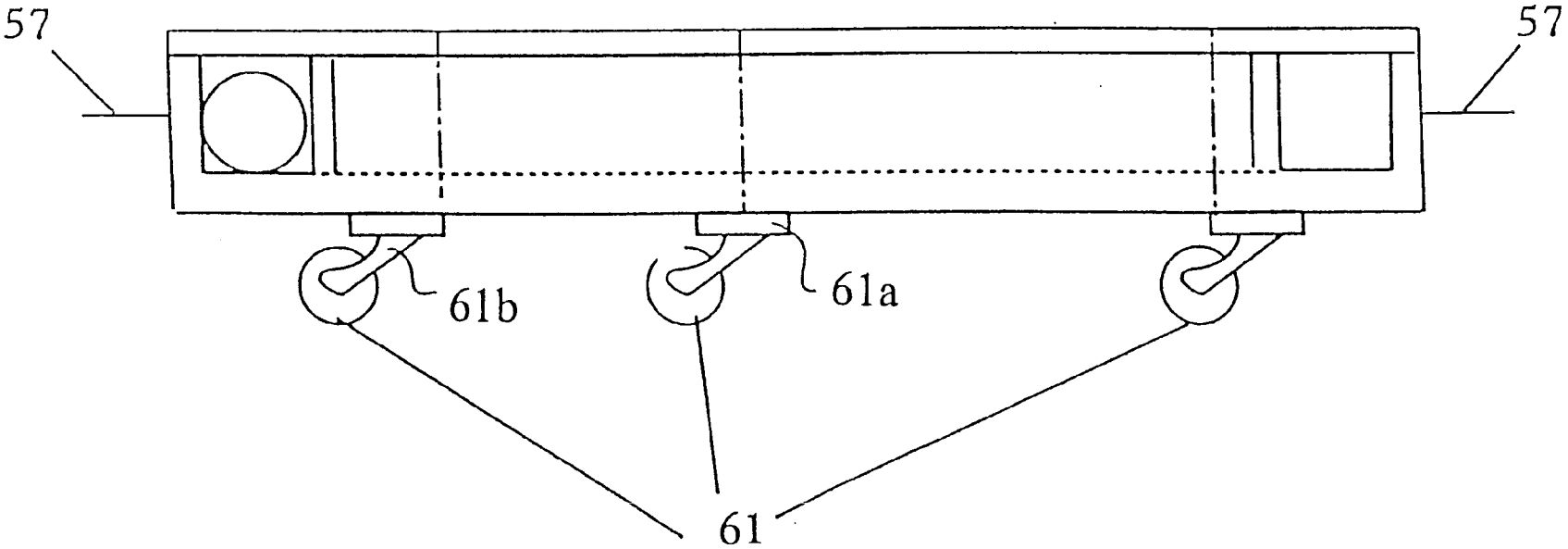
FIG. 22 is a is a front cross-sectional view of the exerciser shown in FIG. 21.

FIGS. 21 and 22 show another variant of the inertial exerciser of the invention. Therein, an exerciser 60 is shown which is similar to the exerciser 55 of FIGS. 19 and 20. A difference between exerciser 55 and exerciser 60 is that exerciser 60 is provided with wheels. In the arrangement shown, three wheels are provided at the bottom of casing 31. Each wheel 61 is spaced approximately 120 degrees from each other wheel at approximately equiangular locations. This spacing provides for appropriate balancing of the exerciser 60. Of course, fewer or more wheels may be used, depending upon the type of use a user of the device requires. The wheels or casters 61 are eccentric to the mounting part of the wheel. As shown, at a mounting part 61*a* is secured to the casing 31. The wheels 61 are offset from the mounting element 61*a* by an extension 61*b*. The extension 61*b* can rotate in the mounting 61*a* and the wheels can roll within the extension 61b. One or more spherical shaped weights are provided within at a recess as in FIGS. 19 and 20. A user of the exerciser 60 places the exerciser on a floor or table top or any other appropriately smooth horizontal surface. Again, movement is imparted to the weights by the user in the same manner as described in FIGS. 19 and 20; however, the exerciser 60 also permits the user to move or roll the exerciser on a flat surface in one direction while at the same time imparting a force to the weights in another direction. For example, the user could roll the device in at a linear direction while imparting a circular motion to the exerciser so as to cause the weight or weights therein to roll/slide within the recess.

Figure 23:
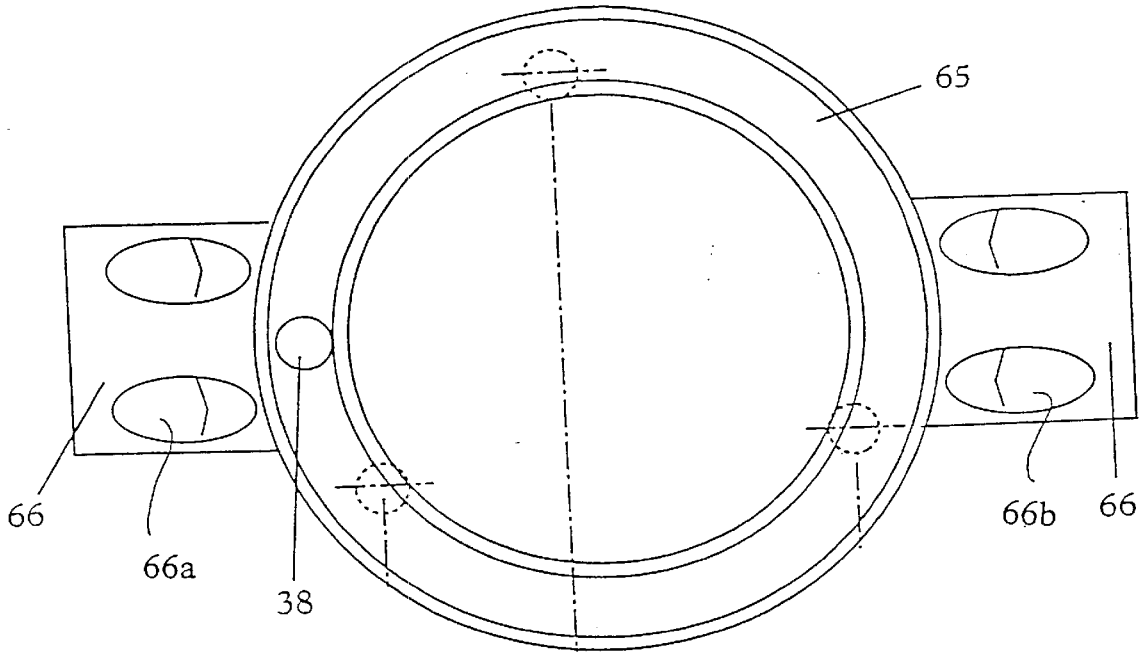
FIG. 23 is a top cross-sectional view of a variation of the exerciser provided with eccentric wheels, and further provided with a foot attachment.
Figure 24:
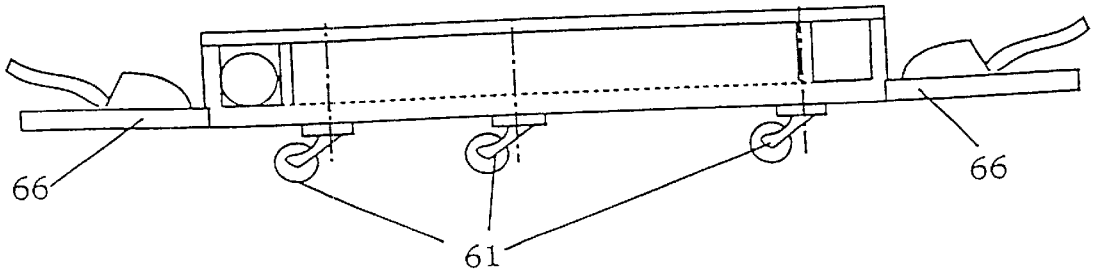
FIG. 24 is a front cross-sectional view of the exerciser shown in FIG. 23.

FIGS. 23 and 24 show an exerciser 65 which is similar to the exerciser 60 of FIGS. 21 and 22. The main difference residing in the provision of control plates 66 secured, as shown in the FIGS., at diametrically opposed sides of the exerciser. FIG. 23 shows the exerciser 65 in at a top, partial cross-sectional view with a pair of foot pads or foot rests 66*a* and 66*b* provided on each of the control panels 66. A user or users of the exerciser 65 could be seated with the exerciser 65 placed on at a substantially flat surface. The user/users insert his/their feet in the foot pads or rests 66*a*, 66*b* and impart motion to the exerciser 65. As the exerciser 65 is provided with the wheel arrangement of FIGS. 21 and 22, similar movements can be imparted to the exerciser. However, all of the movements are imparted by use of leg and foot muscles. The movement may be an orbital, substantially elliptical movement or linear reciprocating movement. The exerciser 65 may also be provided with one or at a plurality of spherical weights.

Figure 25:
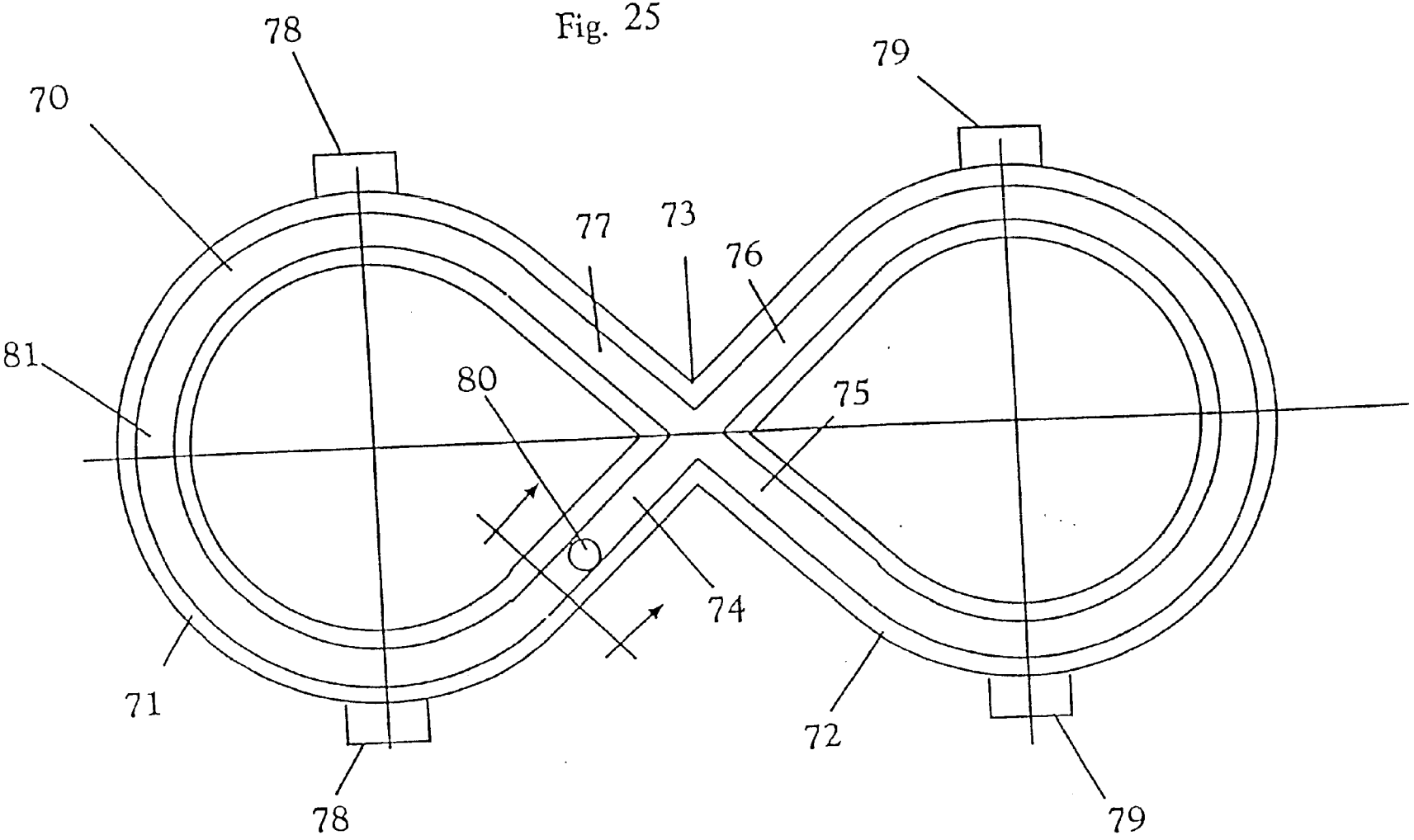
FIG. 25 is a top cross-sectional view of a variation of the exerciser having two connected hook-like members, provided with a partially curved and partially straight, uninterrupted recess, where a spherical shaped weight can circulate.
Figure 26:
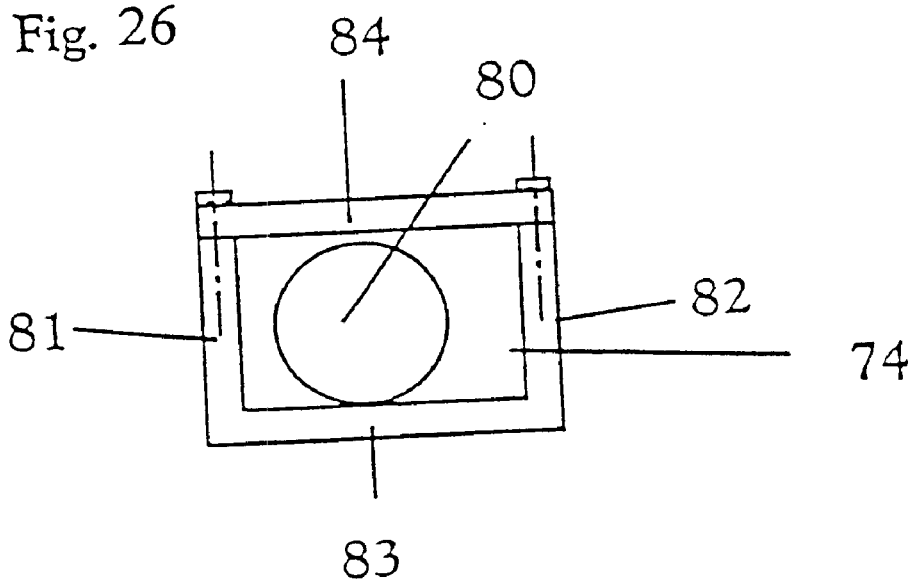
FIG. 26 is a cross-sectional view of a substantially rectilinear section of the exerciser as indicated by the arrows of FIG. 25.

FIGS. 25 and 26 are top cross-sectional and side partial cross-sectional views of an inertial exerciser 70. Operation of the exerciser 70 is intended for two or more people. The exerciser 70 is of at a substantially figure eight shape. The exerciser is in the form of two symmetrical and opposed loops 71 and 72. The loops are connected at a cross-like center portion 73 which is provided with substantially straight sections 74, 75, 76, and 77. The substantially straight sections are integral with the loop portions. Generally, the exerciser 70 is of at a construction similar to the circular exerciser 55 of FIG. 19. That is, a bottom casing portion 83 is provided with substantially parallel side walls 81 and 82 so as to define a recess 74 therein. A top cover plate 84 covers the casing member 83 and is connected to the parallel side walls 81, 82 so as to provide a closed recess 74 in which one or at a plurality of substantially spherically shaped weights 80 can roll and/or slide. The exerciser 70 includes pairs of handles 78 and 79. A pair of users of the exerciser 70 would each grasp a set of handles 78, 79. The users must coordinate their movements so as to impart to the exerciser an orbital, substantially elliptical motion so as to impart and maintain the spherical shaped weight(s) rolling/sliding movement on the figure-eight shaped internal recess 81. Of course, the users must impart and maintain the movement and coordinate their efforts to change movement direction of the weight. The degree of difficulty of controlling movement of the weight may be increased or decreased depending upon how the users are positioned with respect to one another and where they hold the exerciser. For example, the users may face one another to more easily coordinate their efforts and work on the same muscle groups. Alternatively, the users may face the same direction to increase the difficulty for one of the users who must hold the exerciser behind his/her back. This also has the effect of working a different muscle group from that of the other user. Additionally, the difficulty can be increased by holding the exerciser at different height levels and/or angles.

Figure 27:
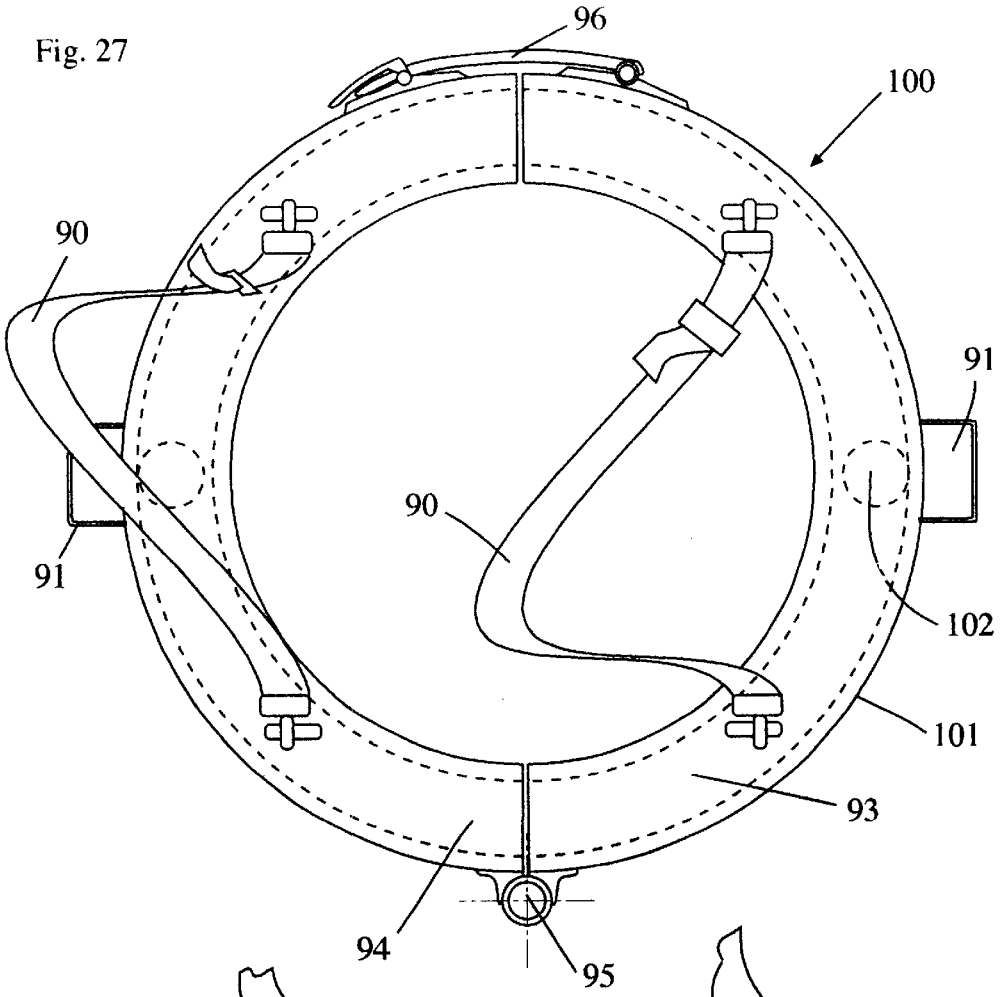
FIG. 27 is a top cross-sectional view of a split hoop-like exerciser which is provided with a central cylindrical aperture, lateral, diametrically opposed handles, two recesses for holding the spherical weights and straps.

FIG. 27 is a top cross-sectional view of another inertial exercise device 100. Exercise device 100 is a split hoop-type device having the shape of a hoop 101 and which can be placed around the user's waist. Hoop 101 has a generally circular or torus configuration and is defined by having a torus shaped hollow recess 98 which receives and confines a moveable weight 102. Hoop 101 is shown having a substantially square (in cross-section) hollow recess 98 which is sufficiently larger than weight 102 so as to allow weigh 102 to move within this recess or space. Hoop 101 can have a substantially square casing 104' with a recess 98' (see FIG. 29) or a substantially rectangular casing 104 (see FIG. 28) with recesses 98, 99. However, it should be noted that both casing 104, 104' and recess 98, 98' and 99 may have other shapes such as circular, oval, egg-shaped, or polygonal. What is necessary for the invention to function properly is that the weight 102 be free to move about within the hoop 101 when the exercise device 100 is being used.

Figure 28:
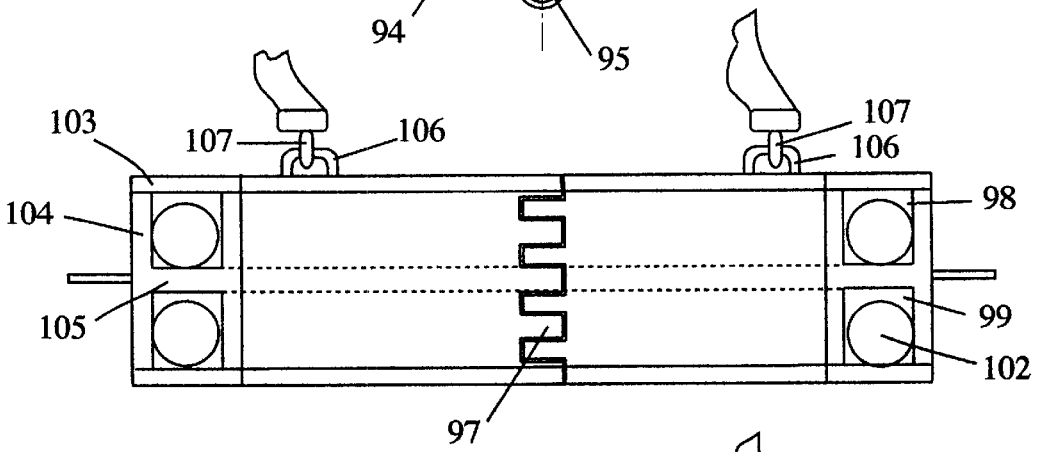
FIG. 28 is a is a front cross-sectional view of the exerciser shown in FIG. 27.

Hoop 101 has external handles 91 for allowing the user to grip the device 100. Device 100 also includes straps 90 which are fastened to the hoop 101 via hooks 106 located at a convenient location, e.g., on a top surface (FIG. 28). However, other attachment mechanisms are also contemplated by the present invention such as various types of bonding, hook and loop, fasteners, or the like. Two straps 90 are utilized, one for each shoulder of the user. Straps 90 are also made adjustable to accommodate the user's preference for positioning of the device. For example, one user may prefer to locate the device 100 at the belt line while another user may prefer to locate it above or below the belt line (not shown). Moreover, the adjustment is necessary to accommodate the fact that different users are of different heights and thus have different distances between the belt line and the shoulders. Straps 90 are also fastened to hoop 101 via attachment links 107 and hooks 106 as shown in FIG. 28. However, it should be note that other attachment mechanisms may be utilized such as direct adhesive attachment or other known attachment mechanisms. Moreover, other conventional mechanisms may be utilized instead of straps 90 such as ropes, elastic members, or the like.

Exercise device 100 is formed by two generally arcuate (shown as semi-circular) segments 93, 94 which together make up the hoop 101. These segments 93, 94 are connected by a hinge 95 so as to be openable and closeable by a latch 96. This design allows the hoop 101 to be opened up so that a user can position it in the vicinity of his or her waist. It should be noted however, that more than two segments 93, 94 may be utilized. Similarly, if two segments are used they do not necessarily have to be semi-circular. Moreover, in such a case additional connecting hinges 95 and clasps 96 may be required.

Connecting hinge 95 forms a connection between semi-circular segment 93 and semi-circular segment 94. The importance of this feature is not that it is a rotating hinge, but rather that it provides a point for connecting semi-circular segments 93, 94, and that this connecting point allows the segments to separate based upon a common pivot point. However, the invention also contemplates connecting the semi-circular segments without a hinge altogether, as for example, when two or more clasps 96 are used (not shown). The utility of the hinge 95 is that the semi-circular segments 93, 94 are not allowed to completely separate and that it is obviously easier to operate one clasp 96 instead of two or more. Clasp 96 also connects semi-circular segments 93, 94 together. Clasp 96 is preferably designed to allow the user to quickly and easily position the hoop 101 around his waist. Clasp 96 should moreover include a safety catch mechanism so that separation does not occur when it is not intended. Moreover, clasp 96 may be selected from a variety of closing mechanisms such as, for example, hook and loop fastening or snap fastening. Preferably, clasp 96 is an over the center toggle type mechanism, but other devices may be utilized.

Additionally, the invention recognizes that once the semi-circular segments 93, 94 are separated, the one or more spherical weights 102 may be caused to fall out via the separated ends of each semi-circular segments 93, 94. For this reason, each segment end may utilize a mechanism (not shown) which prevents the weights 102 from falling out. This mechanism may be in the form of plate that acts to partially close the end when the segments 93, 94 are separated (not shown). Alternatively, each end may be have an internal projection (not shown) which protrudes into the recess 98, 99, and prevents the weight from falling out. Of course such a projection would also prevent the weight 102 from moving freely throughout the entire 360° of movement in the hoop 101. Thus, the mechanism may further include a projection as just described but having the ability to retract out of the recess sufficiently to allow the weight 102 to travel freely therein (not shown). The retraction of the projection would occur in a manner similar to that of the plate in that when the end of one segment 93 contacts the end of the other segment 94 this approaching contact would cause the projection to retract by means of e.g., a simple mechanical linkage (not shown).

Moreover, the invention may be used in a simpler form where there is no mechanism that prevents weight 102 from falling out. In such a case, if the weight falls out, the user can simply place it back into the device 100. This has the advantage that the user can add or subtract as many weights 102 as is desired. Again, as in some of the previous embodiments, the semi-circular segments 93, 94 can be made from a single piece of material which is molded or otherwise fabricated. Moreover, cover 103 may be similarly formed and is preferably secured to the hoop casing 104 via conventional attachment techniques such as adhesive attachment. Alternatively, segments 93, 95 and cover 103 may be formed as integral segment pieces having recesses 98, 98' using conventional fabricating techniques such as molding.

When a substantially elliptical movement is imparted to the device 100, by movement of the waist of the user, the spherical shaped weight or weights 102 roll or slide on the inner surface of the hoop casing 104. Movement of the spherical shaped weight or weights 102 causes the weight to be displaced in a circular movement in a given plane of rotation. The plane of rotation is determined by the position of the device and its orientation by the user of the device.

FIG. 28 shows a frontal cross-section view of exercise device 100 utilizing two hoop recesses 98, 99 which allow the weights 102 to travel within. Exercise device 100 also utilizes mutually cooperating engagement teeth 97 which are formed in each end of the semi-circular segments 93, 94. The advantage of these teeth 97 is that they provide a smooth transition on the inside surfaces of the recess so that the weights 102 can travel uninterruptedly from one segment to another. The invention may utilize a simple butt joint, but this may allow for a gap between the segments 93, 94 which could cause an interruption to the otherwise smooth movements of the weight 102 traveling within recesses 98, 99. Moreover, a butt joint may be utilized at the end having the clasp 96. Alternatively, similar mutually cooperating engagement teeth joint can be utilized in the area of the clasp 96 as well. Separating wall 105 positioned between recess 98, 99 (FIG. 28) acts to separate the two recesses 98 and 99 so that the weights 102 disposed within each of recess 98, 99 do not contact one another.

Figure 29:
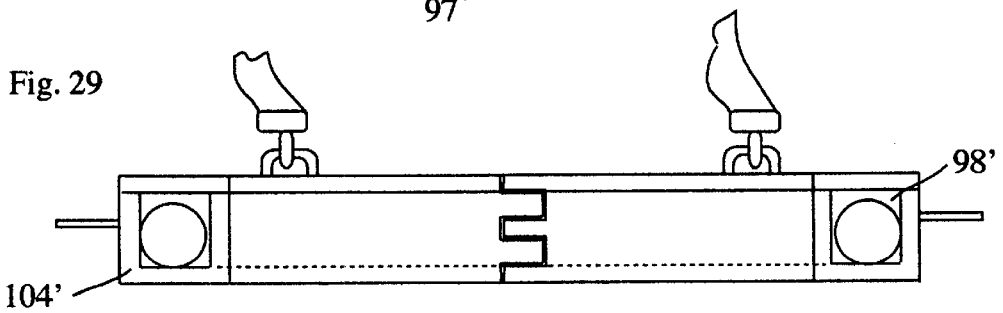
FIG. 29 is a front cross-sectional view of an exerciser similar to that of FIG. 27, provided with a single recess for holding the spherical shaped weight(s)

FIG. 29 shows a frontal cross-section view of the device 100 utilizing a single hoop recesses 98' which allows the weight 102 to travel within. This is simpler version of the structure shown in FIG. 28.

In an even simpler version of the invention, the hoop 101 need not utilize separable semi-circular segments at all (not shown). This version would simply utilize a single circular hoop having a recess 98' and a cover 103 for allowing access to the recess 98' as in some of the previous embodiments. This design would not require either a hinge 95 or a clasp 96. Moreover, the risk of losing the weights 102 when opening segments 93, 94 of device 100 would be eliminated.

An even simpler design eliminates cover 103 altogether, and instead provides for a weight introduction aperture (not shown) which would provide an entrance that allows the weight 102 to be inserted upon the application of a pushing force but would not allow the weight 102 to exit easily, such as, e.g., by use of plastomeric gasket or the like (not shown). Alternatively, a door mechanism (not shown) having an opening which is larger than the weight 102 could be utilized. Such a mechanism may moreover utilize a closing clasp similar to that already discussed above. The advantage of this simpler device is that the user need only step into the opening of the hoop 101 and then simply lift the device 100 up to his waist as if putting-on a pair of pants. The user then slides the straps over his shoulders and adjusts them as necessary.

Of course, such a design has the disadvantage of requiring a hoop opening which can accommodate the largest portion of the user's body so that the hoop can slide up to its preferred position. Alternatively, this design allows the user to position the hoop as if it were a life preserver via the head area. Again, this design would also require a larger hoop opening in order to accommodate the width of the users shoulders. Such a device 100 would be positioned in a manner similar to putting-on a pull-over sweater.

Each of the devices of FIGS. 27–29 operate in the following manner: when a substantially elliptical, circular, or back and forth movement is imparted to the device 100, by movement of the waist of the user or by use of handles 91, the spherically shaped weight or weights 102 roll or slide on the inner surface of the hoop casing 104. Movement of the spherical shaped weight or weights 102 causes the weight(s) to be displaced in a circular movement in a particular plane of rotation. The plane of rotation is determined by the position of the device and its orientation by the user of the device.

The present invention also contemplates that the device 100 may also be used as a sort of wrist band, arm band, head band, or leg band. In such a case, the device 100 should, of course, preferably be made smaller in scale. In function, the operation of these configurations would be similar to that just described. As the user moves a part of the body having the device 100 disposed thereon, this movement causes corresponding movement of the weight 102 within and functions as an exerciser.

The invention also provides a method of exercising using exercise device 100. According to the exercise method of the present invention, a user grasp the device 100 and bring it to a position near his or her waist. The user then opens the hoop 101 and positions it around his or her waist area. The shoulder straps 91 are then slid on to the shoulders and adjusted. The user then closes the hoop 101, being careful to properly operate the closing clasp 96. Now the user can begin to exercise. Safe operation dictates that the user grip a handle 91 with each hand and begin to move his or her body and device 100 about. The movements may be a simple hip rotation or may be a combination of complex locomotion and hip movements. The user can determine his or her own comfort level for exercising in terms of where to place the device on his or her body and how complex to make his movements. Ideally, the user maintains the movement to the extent that positive health benefits result, such as for example, raising his pulse rate for a sufficient time and to an ideal rate. Moreover, the user may decide to remove his hands from the handles 91 and operate the device with it positioned snugly around his or her waist.

Figure 30:
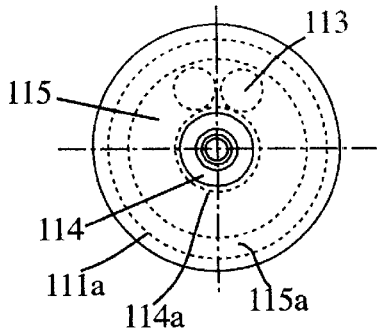
FIG. 30 is a lateral cross-sectional view of a portion of the hand-held exerciser of FIG. 32, showing a single lateral casing having a substantially cylindrical recess for receiving two weights which are shown contacting one another.
Figure 31:
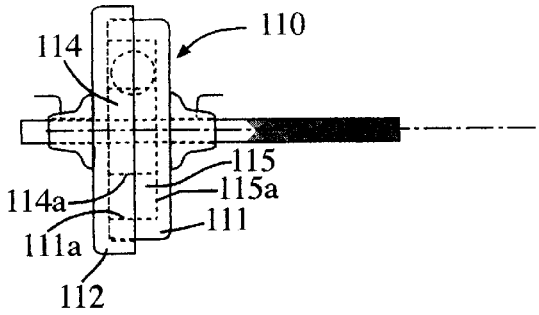
FIG. 31 is a front section of a portion of the hand-held exerciser of FIG. 32.
Figure 32:
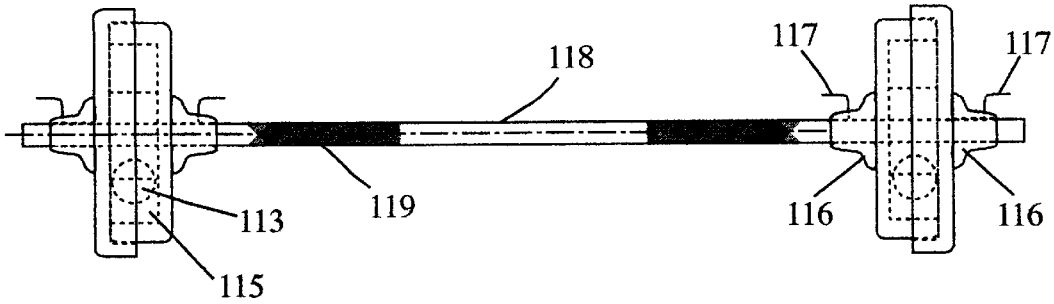
FIG. 32 is a front cross-sectional view of a hand exerciser with a central rod having two ends, each end having a lateral casing mounted thereon and axially retained.
Figure 33:
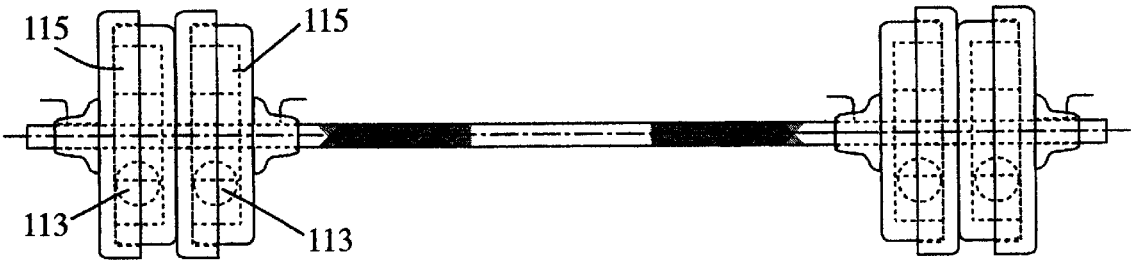
FIG. 33 is a front cross-sectional view of another embodiment of the hand exerciser shown in FIG. 32, with each end having at least two lateral casings mounted thereon and axially retained.

FIGS. 30–33 show another embodiment of a hand-held exerciser of the present invention. Hand-held exerciser includes a casing 110 which is made up of two parts. In this variant, a plurality of weights (at least one weight, and preferably two) are provided in each casing 110. FIG. 32 shows a casing 110 mounted to each end of central rod or handle rod 118, while FIG. 33 shows that more than one casing 110 (in this case two) may be mounted on each end. Casing 110 is provided with at least one substantially spherical weight 113, and preferably two (a pair of weights) as is shown. The pairs of substantially similar spherical weights 113 of casing 110 can roll and/or slide in their respective recesses 115. The user of the hand-held exerciser can put the weights into a circular motion by imparting an orbital, substantially elliptical motion to the exerciser. Alternatively, the user can impart a substantially vertical, linear reciprocating motion to the exerciser, so that the two pairs of spherical weights 113, respectively, move in at a circular reciprocation motion in different directions. The similarity of this embodiment to that of a bar-bell type lifting weight system means that the exerciser may be used in a similar manner. The difference being that the user takes advantage of inertia provided by the moving weights 113 disposed within each casing 110.

As in some of the other previous embodiment discusses herein, when the exerciser is moved downward, weights 113 move toward the top of the recess 115 (see FIGS. 30, 31). At this top part of the recesses 115, the weights collide and change direction of their circular movement. When the exerciser is pushed upwards, the spherical pairs of weights move toward a bottom region of recesses 115 (see FIG. 32), and in at a similar manner, collide with each other. This collision again changes a direction of movement of the weights. This circular reciprocating motion of each pair of weights 113 can be maintained by continuously applying a substantially vertical, linear reciprocating motion.

A casing assembly 110 is mounted to each end of central rod 118. Casing 110 is formed of at least two parts and preferably three parts. The casing 110 is provided having a cylindrical recess 115 which allows one or more weights 113 to move there within. Recess 115 is defined by an outside diameter portion 114*a* of wheel portion 114 and functions as a weight engaging surface 114*a*, which surface is substantially parallel to a central axis of central rod 118. The wheel portion 114 may be integrally formed with the casing 111, but preferably is a separate part. The advantage of this is that by switching different size wheel portions 114, one can vary the cross-sectional recess shape and size. Thus if relatively small weights 113 are used, it may be advantageous to utilize a larger diameter 114*a* wheel portion 114. Moreover, if relatively larger weights 113 are to be used, switching the wheel portion 114 with one that has a smaller diameter 114*a* may be required so that the weights 113 fit within the chamber.

The casing shell 111 also has an inside diameter portion 111*a* which similarly forms a axially parallel weight engaging surface 111*a*. Moreover, recess 115 of casing 111 is further defined by a surface 115*a* which connects the inside and outside diameters and is formed by a connecting wall of casing 111. Recess 115 resembles a donut shaped recess and may have a variety of cross-sectional configurations. FIGS. 30–33 show a substantially square cross-section recess 115 and this shape is preferred due to its ease of manufacture and requires less material to make.

A cover 112 is provided which confines weight(s) 113 within recess 115 together with casing body 111. Cover 112 may have ends which axially overlap casing body 111 so as to provide reinforcement to casing body 111. Moreover, such an overlap ensures that the weight(s) are more securely retained within recess 115.

Casing 110 is axially retained on each end of central rod 118 by a retention device 116 which may be similar to those used to retain free weights on a bar-bell type weight lifting system. Two such retention devices 116 should be used to axially retain each casing 110 on central rod 118 and prevent casing 110 from moving in either of the two opposite axial directions. Moreover, each retention device 116 may employ a securing device 117 (such as, e.g., a hex wrench actuated set screw) to ensure that retention device maintains a desired axial position on central rod.

Central rod or handle rod 118 may further include a grip assist surface 119 which is textured or made to have friction enhancing properties. Preferably, surface 119 is a knurl on or other similar raised textured surface. Alternatively, surface 118 may be friction coating or even a layer of tape. The importance of this surface 119 is its ability to assists the user in more securely gripping the exerciser and in this respect any conventionally known technique may be employed. Ideally, handle rod 118 is made of metal for strength and may be either hollow or solid. However, other material may be used such a composite plastics or the like.

Figure 34:
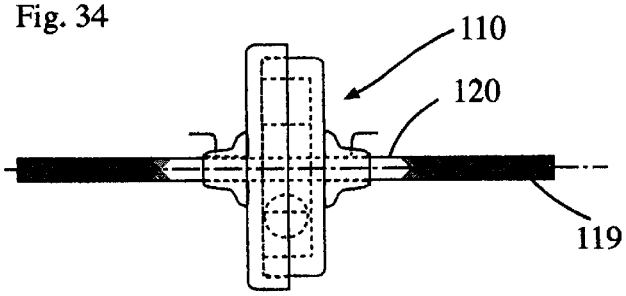
FIG. 34 is a front cross-sectional view of a hand exerciser with a central rod having two ends, with a lateral casing centrally mounted thereon and axially retained, the ends of the central rod serving as handles.
Figure 35:
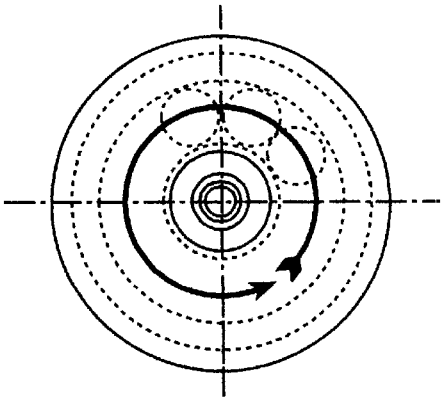
FIG. 35 is a lateral cross-sectional view of a hand-held exerciser of FIG. 37 being rotated in a counter-clockwise direction, with a single lateral casing having a substantially cylindrical recess for receiving a plurality of weights, the figure showing three weights contacting one another.
Figure 36:
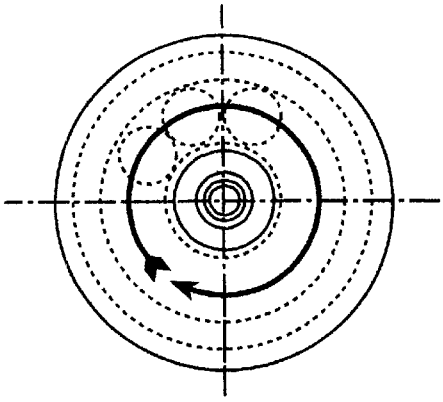
FIG. 36 is same view of the exerciser as FIG. 35 with exerciser being rotated in a clockwise direction.

With reference to FIG. 34 there is shown an other embodiment of an exerciser which uses a single casing 110 and retention devices 116/117 which have already been described. In this embodiment, one or more casings 110 (FIG. 34 shows only one) are centrally disposed on central rod 120. Central rod 120 has friction surfaces 119 on each end which allow the user to grip the exerciser with one end in each hand. This embodiment is used in a similar manner to many of the exerciser devices already discussed herein.

The design of exercisers shown in FIGS. 30–34 provide many of the advantages of the devices previously described. One can appreciate that the user can easily add and subtract weights 113 disposed within casing 110. For this purpose, casing parts 111, 112 are easily separated when they are not forced against one another by the retention devices 116, disposed on opposite sides thereof. This design greatly facilitates the changing of weights 113 for those of greater size and weight or for adding more such weights as the user desires.

Figure 37:
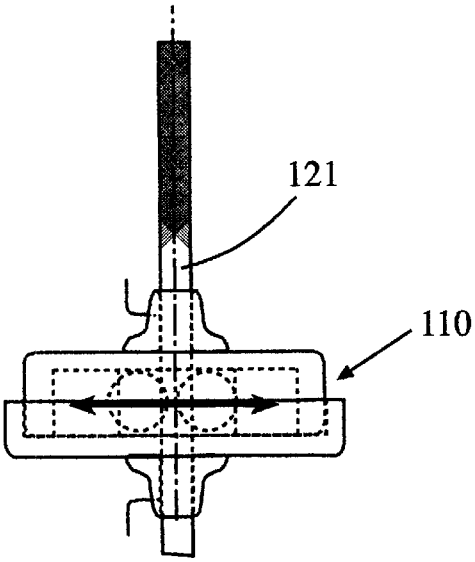
FIG. 37 is a front cross-sectional view of a hand exerciser with a central rod having two ends, with one end serving as a handle and the other end having a lateral casing mounted thereon and axially retained.
Figure 38:
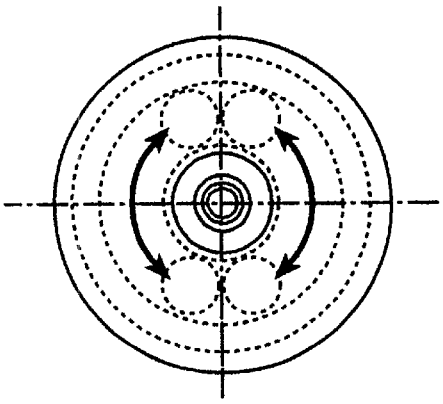
FIG. 38 is a lateral cross-sectional view of a hand-held exerciser of FIG. 37 being partially rotated in a both clockwise and counter-clockwise directions, with the two weights contacting one another at the end of each partial rotation.

With reference to FIGS. 35–38 there is shown an other embodiment of an exerciser which uses a single casing 110 and retention devices 116/117 which have already been described. In this embodiment, one or more casings 110 (FIG. 37 shows only one) are disposed at one end of central rod 120. Central rod 120 has friction surface 119 on the other end which allows the user to grip the exerciser with one hand. Here, three weights 113 are shown, but more than three or as few as one may be employed. Again, this embodiment is used in a similar manner to many of the exerciser devices already discussed herein. That is, the device may be rotated either clockwise or counterclockwise so as to cause the weight(s) to rotate in a desired direction (see FIGS. 35 and 36). Moreover, the exercise device may be moved linearly back and forth to impart a rotational movement to weights 113 (see FIG. 38).

In embodiments of FIGS. 30–38, one can appreciate that different size casings 110 may be used together on handle rod. They may be stacked together similarly to the way free weights are stacked on a bar-bell.

In all variants of the invention, the spherical shaped weights may be made of any suitable plastic material, iron, steel or other metals. The casings of the variations may be made of transparent plastic material or any other suitable material. Moreover, the casing and materials used may be colored any color desired by the user and/or may have any desired exterior embossments and/or indentations and may even include advertisements and various indentations for containing such advertisements. When any lighter weight material is used for the casings, structural metal reinforcements may be used. Such reinforcement material may be applied either integrally or separately to the casing material.

The present application incorporates by reference U.S. patent application Ser. No. 09/120,889, the entire disclosure of which is expressly incorporated by reference herein in its entirety.

It is noted that the foregoing disclosure has been provided merely for the purpose of explanation and is in no way to be construed as limiting of the present invention. While the present invention has been described with reference to at least one preferred embodiment, it is understood that the words which have been used herein are words of description and illustration, rather than words of limitation. Changes may be made, within the purview of the appended claims, as presently stated and as amended, without departing from the scope and spirit of the present invention in its aspects. Although the present invention has been described herein with reference to particular means, materials and embodiments, the present invention is not intended to be limited to the particulars disclosed herein; rather, the present invention extends to all functionally equivalent structures, methods and uses, such as are within the scope of the appended claims.

What is claimed is:

1. An inertial exerciser, comprising:

a substantially circular hoop, the hoop defining a hollow chamber, at least one member disposed in the hollow chamber, the hollow chamber allowing the member received within the hollow chamber to move within the hollow chamber; and one of at least one handle disposed on the hoop and at least one mechanism attached to the hoop for supporting the hoop at a location on a user's body;

wherein the hoop is postionable around a portion of the user's body, wherein the at least one member is movably confined within the hollow chamber and remains within the hollow chamber when the substantially circular hoop is moved in any number of directions.

2. The exerciser of claim 1, wherein the member comprises a substantially spherical weight.

3. The exerciser of claim 2, wherein the substantially spherical weight has a diameter which substantially corresponds to the cross-sectional size of the hollow chamber.

4. An inertial exerciser, comprising:

a substantially circular hoop, the hoop defining a hollow chamber, at least one member disposed in the hollow chamber, the hollow chamber allowing the member received within the hollow chamber to move within the hollow chamber; and one of at least one handle disposed on the hoop and at least one mechanism attached to the hoop for supporting the hoop at a location on a user's body;

wherein the hoop is postionable around a portion of the user's body, and wherein the at least one mechanism comprises a shoulder strap for supporting the hoop on the user.

5. The exerciser of claim 4, wherein the at least one mechanism comprises at least two adjustable shoulder straps for supporting the hoop on the user.

6. The exerciser of claim 1, including the at least one handle and the at least one mechanism.

7. The exerciser of claim 6, wherein the at least one handle comprises at least two handles disposed on the hoop for gripping by the user.

8. An inertial exerciser, comprising:

a substantially circular hoop, the hoop defining a hollow chamber, at least one member disposed in the hollow chamber, the hollow chamber allowing the member received within the hollow chamber to move within the hollow chamber; and one of at least one handle disposed on the hoop and at least one mechanism attached to the hoop for supporting the hoop at a location on a user's body;

wherein the hoop is postionable around a portion of the user's body, and wherein the hoop defines a substantially square cross-section hollow chamber.

9. The exerciser of claim 8, wherein the hoop comprises a substantially square cross-section casing.

10. The exerciser of claim 1, wherein the hoop comprises at least two arcuate segments.

11. The exerciser of claim 10, wherein at least one arcuate segment comprises at least one tooth on one of end for allowing the weight to move within the hollow chamber in an uninterrupted manner.

12. The exerciser of claim 11, wherein each semi-circular segment comprises at least one tooth and wherein a tooth from one segment engages a tooth from another segment.

13. The exerciser of claim 12, further comprising a plurality of teeth disposed on each segment.

14. The exerciser of claim 10, wherein the hoop further comprises a connecting device for connecting the at least two semi-circular segments.

15. The exerciser of claim 14, wherein the connecting device comprises a hinge device.

16. The exerciser of claim 10, wherein the hoop further comprises a securing device for connecting the at least two arcuate segments.

17. The exerciser of claim 16, wherein the securing device comprises clasp device.

18. An inertial exerciser, comprising:

a substantially circular hoop, the hoop defining a hollow chamber, at least one member disposed in the hollow chamber, the hollow chamber allowing the member received within the hollow chamber to move within the hollow chamber; and one of at least one handle disposed on the hoop and at least one mechanism attached to the hoop for supporting the hoop at a location on a user's body;

wherein the hoop is postionable around a portion of the user's body, and wherein the hoop comprises at least two hollow chambers.

19. The exerciser of claim 18, wherein each hollow chamber receives at least one member, the at least one member further comprising a substantially spherical weight.

20. The exerciser of claim 19, further comprising a separating wall positioned between the at least two hollow chambers.

21. The exerciser of claim 19, wherein the at least two hollow chambers are arranged parallel to each other.

22. A method of exercising, comprising:

positioning a substantially circular hoop device about a portion of a user's body;

securing the hoop device on the user using at least one securing mechanism which fixes the hoop device with respect to the portion of the user's body;

moving the hoop device with corresponding movement of the user's body so as to cause a weight disposed in a hollow chamber of the hoop device to move about, wherein the weight is movably confined within the hollow chamber and remains within the hollow chamber when the substantially circular hoop is moved in any number of directions.

23. The method of claim 22, wherein positioning of the hoop device comprises positioning a substantially circular hoop having a substantially circular hollow chamber about the portion of a user's body.

24. The method of claim 23, wherein the positioning further comprises:

opening the hoop device, the hoop device being split into at least two arcuate segments; and closing the hoop device about the user's body and securing the ends of the arcuate segments together using a securing device.

25. A method of exercising, comprising:

positioning a substantially circular hoop device about a portion of a user's body;

securing the hoop device on the user using at least one securing mechanism which fixes the hoop device with respect to the portion of the user's body; and moving the hoop device with corresponding movement of the user's body so as to cause a weight disposed in a hollow chamber of the hoop device to move about, wherein the securing comprises disposing at least one strap, which is attached to the hoop, on a user's shoulder.

26. The method of claim 25, wherein the securing further comprises disposing at least two straps, which are attached to the hoop, on the user's shoulders.

27. The method of claim 22, wherein the positioning comprises positioning the hoop device in the area of the user's waist.

28. The method of claim 22, wherein the moving comprises grasping at least one handle disposed on the hoop and imparting movement to the hoop by at least one handle.

29. An inertial exerciser, comprising:

at least one substantially circular casing, the casing comprising a hollow chamber, at least one member moveably disposed in the hollow chamber, the hollow chamber allowing the member to move within the chamber;

the casing comprising a centrally disposed through opening; and a handle rod at least partially disposed within the opening, wherein the casing is removably fixed to the handle rod so that movement of the handle rod causes movement of the at least one member within the casing.

30. The exerciser of claim 29, wherein the at least one member comprises a substantially spherical weight.

31. The exerciser of claim 30, wherein the substantially spherical weight has a diameter which substantially corresponds to a cross-sectional size of the hollow chamber.

32. The exerciser of claim 29, wherein the handle rod comprises a frictional gripping surface.

33. The exerciser of claim 32, wherein the gripping surface comprises one of a raised surface, a knurled surface, and a textured surface.

34. The exerciser of claim 29, further comprising at least one retention device mounted to the handle rod for preventing axial movement of the at least one casing.

35. The exerciser of claim 34, further comprising at least two retention devices disposed on opposite sides of the at least one casing.

36. The exerciser of claim 29, wherein the hollow chamber comprises a substantially square cross-section.

37. The exerciser of claim 29, wherein at least one casing comprises a substantially circular first portion having a member engaging inner surface which surrounds a member engaging outer surface and a member engaging connecting wall extending between the member engaging inner surface and the member engaging outer surface.

38. The exerciser of claim 37, wherein at least one casing comprises a second portion comprising a member engaging wall.

39. The exerciser of claim 38, wherein the second portion comprises an inside diameter portion which at least partially covers an outer diameter portion of the first portion of the casing.

40. The exerciser of claim 29, wherein the at least one casing is centrally disposed on the handle rod and axially retained by two retaining devices, each retaining device being disposed on an opposite side of the casing.

41. The exerciser of claim 29, wherein the at least one casing is disposed on one end of the handle rod and axially retained by two retaining devices, each retaining device being disposed on an opposite side of the casing.

42. The exerciser of claim 29, wherein at least one casing is disposed on each end of the handle rod and axially retained by two retaining devices, each retaining device being disposed on an opposite side of a casing.

43. The exerciser of claim 42, wherein at least two casings are axially retained on each end of the handle rod.

44. The exerciser of claim 29, wherein the at least one member comprises a plurality of substantially spherical weights.

45. The exerciser of claim 29, wherein the casing further comprises a removable substantially circular wheel portion having a through opening for allowing the handle rod to extend therethrough.

46. The exerciser of claim 45, wherein the substantially circular wheel portion comprises an outside surface which engages the at least one member.

47. A method of exercising using an exerciser device that includes a substantially circular hoop having a hollow chamber and at least two weights movably disposed in the hollow chamber, the method comprising:

positioning the substantially circular hoop about a portion of a user's body; and moving the substantially circular hoop with corresponding movement of the user's body so as to cause the at least two weights disposed in a hollow chamber to move about freely, wherein the at least two weights are movably confined within the hollow chamber and remain within the hollow chamber when the substantially circular hoop is moved in any number of directions.

48. A method of exercising with an exerciser device that includes an enclosure defining a hollow chamber, at least two weights movably disposed within the hollow chamber, and at least one of a handle and a securing mechanism coupled to the enclosure, the method comprising:

gripping a portion of the exerciser device by the user;

moving the exerciser device by the user so as to cause the at least two weights disposed in a hollow chamber to move about freely, wherein the at least two weights are movably confined within the hollow chamber and remain within the hollow chamber when the enclosure is moved in any number of directions.

49. A method of exercising using an exerciser device that includes a substantially circular hoop having a hollow chamber and at least two weights movably disposed in the hollow chamber, the method comprising:

positioning the substantially circular hoop about a portion of a user's body; and moving the substantially circular hoop with corresponding movement of the user's body so as to cause the at least two weights disposed in a hollow chamber to move about freely; and allowing the at least two weights to collide with one another in the hollow chamber.

50. A method of exercising with an exerciser device that includes an enclosure defining a hollow chamber, at least two weights movably disposed within the hollow chamber, and at least one of a handle and a securing mechanism coupled to the enclosure, the method comprising:

gripping a portion of the exerciser device by the user;

moving the exerciser device by the user so as to cause the at least two weights disposed in a hollow chamber to move about freely; and allowing the at least two weights to collide with one another in the hollow chamber.

* * * * *